US010640263B2

(12) United States Patent
Giovannetti et al.

(10) Patent No.: US 10,640,263 B2
(45) Date of Patent: May 5, 2020

(54) TAMPER-RESISTANT CLOSURE ASSEMBLY

(71) Applicants: Zeal Design Limited, Kowloon (HK); Carlos Luchsinger, Portland, OR (US)

(72) Inventors: Roberto Giovannetti, Gava (ES); Carlos Luchsinger, Portland, OR (US); Ciro Davila, Milan (IT); Diego Chuecos, Merida (VE); Kwok Yuen Tung, Fo Tan (HK)

(73) Assignee: Zeal Design Limited, Hong Kong (HK)

( * ) Notice: Subject to any disclaimer, the term of this patent is extended or adjusted under 35 U.S.C. 154(b) by 0 days.

(21) Appl. No.: 16/314,621

(22) PCT Filed: Apr. 25, 2018

(86) PCT No.: PCT/US2018/029461
§ 371 (c)(1),
(2) Date: Dec. 31, 2018

(87) PCT Pub. No.: WO2018/200741
PCT Pub. Date: Nov. 1, 2018

(65) Prior Publication Data

US 2020/0047954 A1 Feb. 13, 2020

Related U.S. Application Data

(60) Provisional application No. 62/490,017, filed on Apr. 25, 2017.

(51) Int. Cl.
*B65D 85/10* (2006.01)
*B65D 39/08* (2006.01)
(Continued)

(52) U.S. Cl.
CPC ..... *B65D 39/082* (2013.01); *A24F 15/20* (2013.01); *B65D 51/26* (2013.01); *B65D 53/02* (2013.01); *B65D 55/02* (2013.01)

(58) Field of Classification Search
CPC .. B65D 21/08; B65D 39/082; B65D 41/0471; B65D 51/26; B65D 53/02; B65D 55/02; F16B 37/085
(Continued)

(56) References Cited

U.S. PATENT DOCUMENTS 1,023,641 A 4/1912 Greer
3,630,403 A 12/1971 Berg
(Continued)

FOREIGN PATENT DOCUMENTS

DE 102006060143 7/2008

OTHER PUBLICATIONS

International Search Report and Written Opinion for PCT Application No. PCT/US2018/029461, dated Oct. 29, 2018, 17 pages.
(Continued)

*Primary Examiner* — Luan K Bui
(74) *Attorney, Agent, or Firm* — Ganz Pollard, LLC

(57) ABSTRACT

A tamper-resistant closure assembly, comprising an elongate body having a proximal end and a distal end; a ferrule defining an interior major surface, wherein the interior major surface has a proximal region and a distal region; and a boss positioned adjacent the distal end of the elongate body and configured to resiliently urge outwardly against the interior major surface; wherein the elongate body is slidably retained within the ferrule by a shoulder extending radially outward of the elongate body; wherein the ferrule, the elongate body, or both defines a region so complementarily arranged relative to the boss as to resiliently urge the elongate body in a proximal direction relative to the ferrule in correspondence with a radially outward force applied by the boss against the interior major surface.

30 Claims, 15 Drawing Sheets

(51) Int. Cl.

| | |
|---|---|
| ***A24F 15/20*** | (2006.01) |
| *B65D 53/02* | (2006.01) |
| *B65D 55/02* | (2006.01) |
| *B65D 51/26* | (2006.01) |

(58) Field of Classification Search
USPC ..... 206/242, 256; 215/250, 354; 220/8, 288, 220/304, 787, 788
See application file for complete search history.

(56) References Cited

U.S. PATENT DOCUMENTS

| | | | | |
|---|---|---|---|---|
| 3,924,772 | A * | 12/1975 | Magnani | B65D 41/28 215/276 |
| 5,143,239 | A * | 9/1992 | Yang | B65D 39/082 220/254.9 |
| 5,562,218 | A | 10/1996 | Hamilton et al. | |
| 5,829,581 | A * | 11/1998 | Wicker | A24F 25/02 206/213.1 |
| 6,217,269 | B1 * | 4/2001 | Jentzen | B65D 41/0471 411/296 |
| 7,562,768 | B2 * | 7/2009 | Tokarski | A45C 11/005 206/5.1 |
| 8,584,842 | B2 * | 11/2013 | Fakhouri | A24F 9/04 206/236 |
| 9,089,166 | B1 | 7/2015 | Scatterday | |
| 2002/0079286 | A1 | 6/2002 | Haynes et al. | |
| 2005/0061764 | A1 * | 3/2005 | Tamashiro | B65D 7/04 215/12.1 |
| 2013/0025608 | A1 | 1/2013 | Fakhouri et al. | |
| 2015/0122768 | A1 | 5/2015 | Hadar et al. | |
| 2016/0075474 | A1 * | 3/2016 | Kinaya | B65D 21/08 206/507 |

OTHER PUBLICATIONS

International Preliminary Report on Patentability for PCT Application No. PCT/US2018/029461, dated Nov. 7, 2019, 13 pages.

* cited by examiner

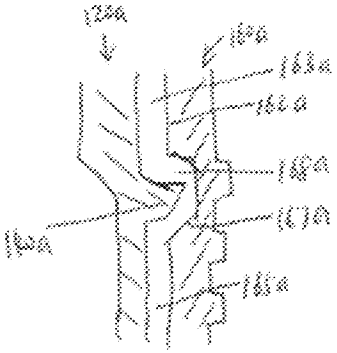
FIG. 4A
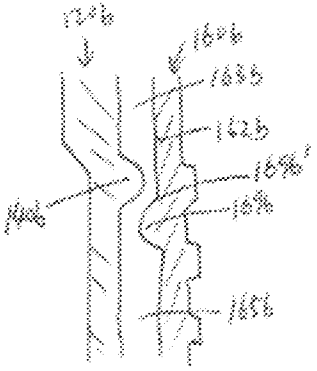
FIG. 4B
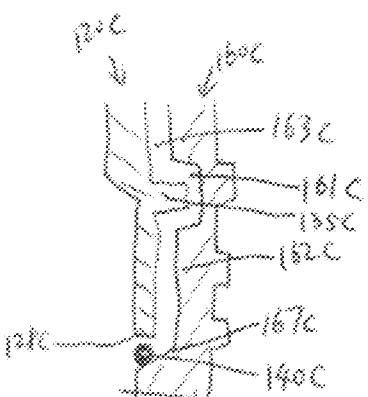
FIG. 4C
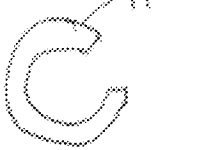
FIG. 4C'
FIG. 4E
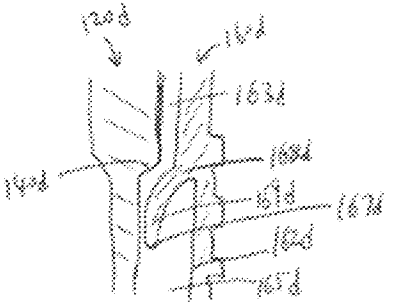
FIG. 4D
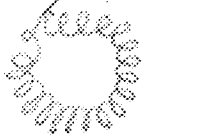
FIG. 4C''

TAMPER-RESISTANT CLOSURE ASSEMBLY

BACKGROUND

The inventive subject matter disclosed herein, which encompasses various embodiments and permutations of inventive features, generally relates to tamper-resistant closure assemblies for storing cigarettes and the like.

Generally speaking, a cigarette is a cylinder of thin paper or herbaceous leaf filled with finely cut herbaceous material for smoking. When used, a distal end of the cigarette is ignited causing the finely cut herbaceous material to smolder. Smoke from the smoldering herbaceous material can be ingested by a user, as by inhaling smoke through the user's mouth from an opposed proximal end (sometimes referred to as a "suction-end"). In some instances, a cigarette holder may also be used to retain, or hold, the suction end for use. Some modern, manufactured cigarettes include a filter positioned proximally of the herbaceous fill material as to remove one or more products of combustion from the smoke before ingestion by a user. Examples of herbaceous fill material include, without limitation, leaves and/or flowers of a variety of plants, for example, blue lotus, sage, damiana, mullein, catnip, tobacco, cloves, etc. The cigarettes can also contain mixtures of different herbs.

Cigarettes may be hand-rolled by the user with rolling papers, or they may be machine-rolled. A cigarette can vary in size, e.g., super slim size (about 120 mm in length and about 4.8 mm in diameter), standard or demi slim size (about 84 mm in length and about 5.2 mm in diameter), or king size (about 84 mm in length and about 7.9 mm in diameter).

Despite the common use of cigarettes, there has been a lack of a safe, effective, and convenient way for the storage of new or partially consumed cigarettes. For example, many cigarette containers are not child-safe such that a child may incidentally open the container and suffers an adverse reaction to the consumption of cigarette. Many cigarette containers are not tightly sealed. Accordingly, the odor of the cigarette may escape the container, and the moisture can also get into or escape from the container, affecting the moisture content and freshness of the cigarette, and compromising its taste and effects. Moreover, for most cigarette containers, the stored cigarettes are loosely packed and not secured. Accordingly, when a person carries such a container in travel or accidentally drops the container on the floor, the stored cigarettes may dangle inside or hit the walls of the container, causing the cigarettes to disintegrate. Further, currently there is no effective solutions for the storage of partially consumed cigarettes. In addition, most cigarette containers are not designed for user convenience. For example, a user cannot use it as a temporarily holder for a partially consumed cigarette when he temporarily pauses smoking. Or a user may not find other accessories necessary for smoking such as a lighter, a rolling paper, a grinder, etc.

Thus, there is a need for improved containers that address these problems.

SUMMARY

The innovations disclosed herein overcome many problems in the prior art and address one or more of the aforementioned or other needs. In some respects, the innovations disclosed herein are directed to tamper-resistant closure assemblies for storing cigarettes.

A tamper-resistant closure assembly can include an elongate body having a proximal end and a distal end. The tamper-resistant closure assembly can include a ferrule defining an interior major surface. The interior major surface can have a proximal region and a distal region. The tamper-resistant closure assembly can also include a boss positioned adjacent the distal end of the elongate body and configured to resiliently urge outwardly against the interior major surface. The elongate body can be slidably retained within the ferrule by a shoulder extending radially outward of the elongate body. The ferrule, the elongate body, or both can define a region so complementarily arranged relative to the boss as to resiliently urge the elongate body in a proximal direction relative to the ferrule in correspondence with a radially outward force applied by the boss against the interior major surface.

In some embodiments, the tamper-resistant closure assembly can also include an external engagement member and a sheath. The external engagement member can be configured to removably couple with a complementarily arranged region of the sheath.

In some embodiments, the external engagement member can include an external thread and the complementarily arranged region of the sheath can include an internal thread that is complementary to the external thread.

In some embodiments, the tamper-resistant closure assembly can further include a seal member that extends from an external surface of the elongate body to a corresponding internal surface of the sheath to sealingly engage the sheath when the external engagement member is coupled with the complementarily arranged region of the sheath.

In some embodiments, the boss can define a portion of a spring lever disposed within a region of the elongate body.

In some embodiments, the boss can include a resilient ring structure.

In some embodiments, the elongate body can have a first and a second recess regions that are joined by a transition region. Each respective region can be complementarily sized to matingly receive a correspondingly sized suction-end of a cigarette.

In some embodiments, the proximal region can have a greater cross-sectional dimension than the distal region. A sloped face can be positioned between the proximal region and the distal region.

In some embodiments, the elongate body can further include a first plurality of juxtaposed teeth spaced apart from each other to define a first plurality of juxtaposed recesses therebetween, and the ferrule can further include a second plurality of juxtaposed teeth spaced apart from each other to define a second plurality of juxtaposed recesses therebetween. The first plurality of juxtaposed teeth are complementary to the second plurality of juxtaposed recesses, and the second plurality of juxtaposed teeth are complementary to the first plurality of juxtaposed recesses.

In some embodiments, the boss can be urged toward the distal position when the elongate body is pressed toward a lowered position by applying a pressure to the proximal end, so that the first plurality of juxtaposed teeth and the corresponding recesses can rotationally engage the complementary second plurality of juxtaposed recesses and the corresponding teeth. The boss can expand outwardly and move toward the proximal region thereby urging the elongate body to a raised position when the pressure is released, so that the first plurality of juxtaposed teeth and the corresponding recesses disengage the complementary second plurality of juxtaposed recesses and the corresponding teeth.

Also disclosed is a tamper-resistant closure assembly that can include a sheath, an elongate body having a proximal end and a distal end, and a ferrule defining an interior major surface. The interior major surface can have a proximal region and a distal region. The tamper-resistant closure assembly can also include a boss positioned adjacent the distal end of the elongate body and configured to resiliently urge outwardly against the interior major surface. The elongate body can be slidably retained within the ferrule by a shoulder extending radially outward of the elongate body. The ferrule, the elongate body, or both can define a region so complementarily arranged relative to the boss as to resiliently urge the elongate body in a proximal direction relative to the ferrule in correspondence with a radially outward force applied by the boss against the interior major surface. The ferrule can also have an external engagement member configured to removably couple with a complementarily arranged region of the sheath.

In some embodiments, the external engagement member can include an external thread and the complementarily arranged region of the sheath can include an internal thread that is complementary to the external thread.

In some embodiments, the tamper-resistant closure assembly can further include a seal member that extends from an external surface of the elongate body to a corresponding internal surface of the sheath to sealingly engage the sheath when the external engagement member is coupled with the complementarily arranged region of the sheath.

In some embodiments, the boss can define a portion of a spring lever disposed within a region of the elongate body.

In some embodiments, the boss can include a resilient ring structure.

In some embodiments, the elongate body can have a first and a second recess regions that are joined by a transition region. Each respective region can be complementarily sized to matingly receive a correspondingly sized suction-end of a cigarette.

In some embodiments, the proximal region can have a greater cross-sectional dimension than the distal region. A sloped face can be positioned between the proximal region and the distal region.

In some embodiments, the elongate body can further include a first plurality of juxtaposed teeth spaced apart from each other to define a first plurality of juxtaposed recesses therebetween, and the ferrule can further include a second plurality of juxtaposed teeth spaced apart from each other to define a second plurality of juxtaposed recesses therebetween. The first plurality of juxtaposed teeth are complementary to the second plurality of juxtaposed recesses and the second plurality of juxtaposed teeth are complementary to the first plurality of juxtaposed recesses.

In some embodiments, the boss can be urged toward the distal positon when the elongate body is pressed toward a lowered position by applying a pressure to the proximal end, so that the first plurality of juxtaposed teeth and the corresponding recesses can rotationally engage the complementary second plurality of juxtaposed recesses and the corresponding teeth. The boss can expand outwardly and move toward the proximal region thereby urging the elongate body to a raised position when the pressure is released, so that the first plurality of juxtaposed teeth and the corresponding recesses disengage the complementary second plurality of juxtaposed recesses and the corresponding teeth.

Also disclosed is a tamper-resistant closure assembly that can include a sheath having an internal thread, an elongate body having a proximal end and a distal end, and a ferrule defining an interior major surface. The interior major surface can have a proximal region and a distal region, and the ferrule can include an external thread that is complementary to the internal thread of the sheath so that the ferrule can be removably coupled with the sheath. The tamper-resistant closure assembly can also include a seal member that extends from an external surface of the elongate body to a corresponding internal surface of the sheath to sealingly engage the sheath when the external thread of the ferrule is coupled with the internal thread of the sheath. Further, the tamper-resistant closure assembly can further include a boss positioned adjacent the distal end of the elongate body and configured to resiliently urge outwardly against the interior major surface. The elongate body can be slidably retained within the ferrule by a shoulder extending radially outward of the elongate body. The ferrule, the elongate body, or both can define a region so complementarily arranged relative to the boss as to resiliently urge the elongate body in a proximal direction relative to the ferrule in correspondence with a radially outward force applied by the boss against the interior major surface. The elongate body can further include a first plurality of juxtaposed teeth spaced apart from each other to define a first plurality of juxtaposed recesses therebetween, and the ferrule can further include a second plurality of juxtaposed teeth spaced apart from each other to define a second plurality of juxtaposed recesses therebetween. The first plurality of juxtaposed teeth are complementary to the second plurality of juxtaposed recesses and the second plurality of juxtaposed teeth are complementary to the first plurality of juxtaposed recesses.

Alternatively, a tamper-resistant closure assembly can include a cap, an interior frame having a receptacle, and a case defining a compartment that retains the interior frame. The case can be complementarily arranged relative to the cap so that the compartment is enclosed when the cap covers a top opening of the compartment. The tamper-resistant closure assembly can also include a vertical shaft to which the cap is affixed and from which the cap is cantilevered. The shaft can have a first keymate and a second keymate that are longitudinally separated and circumferentially offset from each other. The first keymate can be positioned longitudinally proximal of the second keymate relative to the cap. In addition, the tamper-resistant closure assembly can include a latch being movable between a locked position and a released position. The latch can include a key that is complementarily sized and shaped to selectively and matingly engage the first keymate and the second keymate when the latch is in the locked position, and disengage the first keymate or the second keymate when the latch is in the released position. The shaft can be secured in a closed position where the affixed cap covers the top opening of the compartment when the latch is in the locked position and the key matingly engages the first keymate. In addition, the shaft can translate longitudinally along a longitudinal axis of the shaft and rotate about the longitudinal axis when the latch is in the released position. Further, the shaft can be secured in a deployment position where the affixed cap is displaced from the top opening of the compartment when the latch is in the locked position and the key matingly engages the second keymate.

In some embodiments, the tamper-resistant closure assembly can also include a container configured to be slidably retained by the receptacle. The container can include an internally threaded sheath.

In some embodiments, the container can further include an elongate body having a proximal end and a distal end, and a ferrule defining an interior major surface. The interior major surface can have a proximal region and a distal region. The container can also include a boss positioned adjacent the distal end of the elongate body and configured to resiliently urge outwardly against the interior major surface. The elongate body can be slidably retained within the ferrule by a shoulder extending radially outward of the elongate body. The ferrule, the elongate body, or both can define a region so complementarily arranged relative to the boss as to resiliently urge the elongate body in a proximal direction relative to the ferrule in correspondence with a radially outward force applied by the boss against the interior major surface. Further, the ferrule can have an external thread that is complementary to the internal thread of the sheath so that the ferrule can be removably coupled with the sheath.

In some embodiments, the container can further include an externally threaded shaft assembly configured to removably engage the internal thread of the sheath. An internal major surface of the shaft can define an open recess. A floor of the recess can include a conically recessed region and a plurality of slots extending through the floor, thereby defining a plurality of exposed edges.

In some embodiments, the floor of the recess can include a heat-resistant material.

In some embodiments, the tamper-resistant closure assembly can also include a seal member positioned underneath the cap and over an upper plate of the interior frame.

In some embodiments, the tamper-resistant closure assembly can further include a lighter. The lighter can include a heating element and an electronic circuitry that is configured to activate or deactivate the heating element.

In some embodiments, the electronic circuitry can be coupled to the latch and a switch, and the switch can be turned ON or OFF.

In some embodiments, the electronic circuitry can be configured to activate the heating element when the latch is in the released position and the switch is turned ON, and deactivate the heating element when the latch is in the locked position or the switch is turned OFF.

In some embodiments, the lighter can include a battery and an interface to an external charger for charging the battery.

Also disclosed is a tamper-resistant closure assembly that can include a cap, an interior frame that can include a receptacle, and a case defining a compartment that can retain the interior frame. The case can be complementarily arranged relative to the cap so that the compartment is enclosed when the cap covers a top opening of the compartment. The tamper-resistant closure assembly can also include a vertical shaft to which the cap is affixed and from which the cap is cantilevered. The shaft can have a first keymate and a second keymate that are longitudinally separated and circumferentially offset from each other. The first keymate can be positioned longitudinally proximal of the second keymate relative to the cap. The tamper-resistant closure assembly can further include a latch being movable between a locked position and a released position. The latch can have a key that is complementarily sized and shaped to selectively and matingly engage the first keymate and the second keymate when the latch is in the locked position, and disengage the first keymate or the second keymate when the latch is in the released position. The shaft can be secured in a closed position where the affixed cap covers the top opening of the compartment when the latch is in the locked position and the key matingly engages the first keymate. The shaft can translate longitudinally along a longitudinal axis of the shaft and rotate about the longitudinal axis when the latch is in the released position. The shaft can also be secured in a deployment position where the affixed cap is displaced from the top opening of the compartment when the latch is in the locked position and the key matingly engages the second keymate. Further, the tamper-resistant closure assembly can include a lighter, which can include a heating element and an electronic circuitry that is configured to activate or deactivate the heating element. The electronic circuitry can be operatively coupled to the latch and a switch, which can be turned ON or OFF. The electronic circuitry can be configured to activate the heating element when the latch is in the released position and the switch is turned ON, and deactivate the heating element when the latch is in the locked position or the switch is turned OFF.

In some embodiments, the tamper-resistant closure assembly can further include a container configured to be slidably retained by the receptacle.

In some embodiments, the container can include a sheath, an elongate body, and a ferrule. The sheath can have an internal thread, the elongate body can have a proximal end and a distal end, and the ferrule can define an interior major surface, which can have a proximal region and a distal region. The container can also have a boss positioned adjacent the distal end of the elongate body and configured to resiliently urge outwardly against the interior major surface. The elongate body can be slidably retained within the ferrule by a shoulder extending radially outward of the elongate body. The ferrule, the elongate body, or both can define a region so complementarily arranged relative to the boss as to resiliently urge the elongate body in a proximal direction relative to the ferrule in correspondence with a radially outward force applied by the boss against the interior major surface. The ferrule can have an external thread that is complementary to the internal thread of the sheath so that the ferrule can be removably coupled with the sheath.

In some embodiments, the container can include a sheath and a shaft, and an external thread of the shaft can be configured to removably engage an internal thread of the sheath. An internal major surface of the shaft can define an open recess, and a floor of the recess can include a conically recessed region and a plurality of slots extending through the floor, thereby defining a plurality of exposed edges.

In some embodiments, the floor of the recess can include a heat-resistant material.

In some embodiments, the tamper-resistant closure assembly can further include a seal member positioned underneath the cap and over an upper plate of the interior frame.

Also disclosed is a tamper-resistant closure assembly that can include a hinged cap, an interior frame that can include a first receptacle and a case defining a compartment that retains the interior frame. The case can be complementarily arranged relative to the cap so that the compartment is enclosed when the cap covers a top opening of the compartment. The tamper-resistant closure assembly can also include a first container configured to be slidably retained by the first receptacle. The first container can include a sheath, an elongate body, and a ferrule. The sheath can have an internal thread, the elongate body can have a proximal end and a distal end, and the ferrule can define an interior major surface, which can have a proximal region and a distal region. The first container can also include a boss positioned adjacent the distal end of the elongate body and configured to resiliently urge outwardly against the interior major surface. The elongate body can be slidably retained within the ferrule by a shoulder extending radially outward of the elongate body. The ferrule, the elongate body, or both can define a region so complementarily arranged relative to the boss as to resiliently urge the elongate body in a proximal direction relative to the ferrule in correspondence with a radially outward force applied by the boss against the interior major surface. The ferrule can have an external thread that is complementary to the internal thread of the sheath so that the ferrule can be removably coupled with the sheath.

In some embodiments, the tamper-resistant closure assembly can further include a second container, and the interior frame can further include a second receptacle, and the second container can be configured to be slidably retained by the second receptacle.

In some embodiments, the second container can include an externally threaded shaft assembly removably engaged with an internally threaded sheath. An internal major surface of the second container's shaft can define an open recess, and a floor of the recess can include a conically recessed region and a plurality of slots extending through the floor, thereby defining a plurality of exposed edges.

In some embodiments, the tamper-resistant closure assembly can further include a lighter. The lighter can include a heating element and an electronic circuitry that is configured to activate or deactivate the heating element. The electronic circuitry can be operatively coupled to the cap and a switch, and the switch can be turned ON or OFF. The electronic circuitry can be configured to activate the heating element when the cap is open to expose the top opening of the compartment and the switch is turned ON, and deactivate the heating element when the cap covers the top opening of the compartment or the switch is turned OFF.

Also disclosed is an opening-resistant assembly for a container that can include a cap defining a user-graspable region and an externally threaded member defining an external thread positioned distally of the user-graspable region of the cap. The cap and the externally threaded member can be longitudinally moveable relative to each other from a first extent to a second extent. At the first extent, the cap and the externally threaded member can be so circumferentially disengaged from each other as to be independently rotatable. At the second extent, the cap and the externally threaded member so circumferentially engage with each other as to be circumferentially co-rotatable. The assembly can further include an O-ring seated in a groove positioned between the user-graspable region of the cap and the external thread.

The opening-resistant assembly can include a sheath defining an opening at a proximal end to receive the externally threaded member. The sheath can further define a complementarily configured internal thread positioned distally of the opening that is operative to threadably engage with the external thread of the externally threaded member.

The cap can be independently rotatable with respect to both the externally threaded member and the sheath at the first extent and when the external thread of the externally threaded member and the internal thread of the sheath are threadably engaged with each other. The cap and the externally threaded member can be co-rotatable to threadably disengage the externally threaded member from the sheath at the second extent, when the external thread of the externally threaded member and the internal thread of the sheath are threadably engaged with each other.

The sheath can define an internal surface to sealingly engage with the O-ring seated in the groove defined by the cap. The internal surface defined by the sheath can be positioned distally of the opening and proximally of the internal thread defined by the sheath.

The O-ring can be configured to provide at least one of a water resistant or an air-tight seal between the externally threaded member and the interior surface of the sheath.

The sheath can be operative to enclose a cigarette suspended by the cap and externally threaded member assembly.

The cap and the externally threaded member can be so longitudinally engaged with each other as to inhibit longitudinal displacement past the first extent relative to each other.

The cap can define a shoulder and the externally threaded member can define a complementary shoulder, such that the shoulder and the complementary shoulder urge against each other at the first extent to inhibit longitudinal displacement past the first extent.

The cap can include a first a plurality of teeth and the externally threaded member can include a second plurality of teeth. The first plurality of teeth can circumferentially engage the second plurality of teeth at the second extent.

The cap and the externally threaded member can be circumferentially co-rotatable when the user-graspable region is rotated circumferentially while at the second extent.

The cap and externally threaded member assembly can define a recess for holding a suction-end of a cigarette.

The opening-resistant assembly can further include a floor defining a fluted aperture and a plurality of resilient flaps operative to urge against and to frictionally engage a suction-end of a cigarette extending through the aperture.

The opening-resistant assembly can further include a sheath insert disposed inside the recess, wherein the fluted aperture is a component of the sheath insert.

The floor can include a pliant member matingly engaged with a distal end of the recess.

Also disclosed is an opening-resistant assembly for a container, comprising an elongate body defining a user-graspable region and having a first plurality of teeth; a ferrule overlying the elongate body and having a second plurality of teeth, wherein the ferrule defines an external thread positioned distally of the user-graspable region of the elongate body, wherein the ferrule defines an open distal end and a recess extending proximally from the open distal end to receive a suction-end of a cigarette; a plurality of resilient flaps extending across the recess at the open distal end to define a fluted aperture opening to the recess, wherein the resilient flaps are operative to deflect inwardly as the suction-end of the cigarette urges through the fluted aperture and to frictionally engage with the suction-end of the cigarette when the suction-end of the cigarette extends through the fluted aperture, wherein the elongate body and the ferrule are longitudinally moveable relative to each other from a first extent to a second extent, wherein, at the first extent, the elongate body and the ferrule are independently rotatable, and wherein, at the second extent, the first plurality of teeth and the second plurality of teeth circumferentially engage with each other such that the elongate body and the ferrule are circumferentially co-rotatable; an O-ring seated in a groove positioned between the user-graspable region of the elongate body and the external thread; and a sheath defining an opening at a proximal end to receive the ferrule, a complementarily configured internal thread operative to threadably engage with the external thread of the ferrule, and sized to enclose a cigarette suspended within the fluted aperture, and defining an internal surface to sealingly engage with the O-ring seated in the groove, wherein, at the first extent and when the external thread of the ferrule and the internal thread of the sheath are threadably engaged with each other, the elongate body is independently rotatable with respect to the ferrule and to the sheath, wherein, at the second extent and when the external thread of the ferrule and the internal thread of the sheath are threadably engaged with each other, the elongate body and the ferrule are circumferentially co-rotatable to threadably disengage the ferrule from the sheath.

The opening-resistant assembly for a container can further include a boss positioned adjacent a distal end of the elongate body that can be configured to resiliently urge outwardly against the ferrule overlying the elongate body. The ferrule, the elongate body, or both can define a region so complementarily arranged relative to the boss as to resiliently urge the elongate body in a proximal direction relative to the ferrule in correspondence with a radially outward force applied by the boss against the ferrule.

The foregoing and other features and advantages will become more apparent from the following detailed description, which proceeds with reference to the accompanying drawings.

BRIEF DESCRIPTION OF THE DRAWINGS

Unless specified otherwise, the accompanying drawings illustrate aspects of the innovations described herein. Referring to the drawings, wherein like numerals refer to like parts throughout the several views and this specification, several embodiments of presently disclosed principles are illustrated by way of example, and not by way of limitation.

FIG. 4A shows a portion of a cross-sectional view similar to the view in FIG. 3 as an alternative arrangement of a tamper-resistant closure assembly as shown in FIG. 1A.

FIG. 4B shows a portion of a cross-sectional view similar to the view in FIG. 3 revealing another embodiment of the tamper-resistant closure assembly as shown in FIG. 1A.

FIG. 4C shows a portion of a cross-sectional view similar to the view in FIG. 3 revealing yet another embodiment of the tamper-resistant closure assembly as shown in FIG. 1A.

FIG. 4C' shows an embodiment of a resilient ring structure depicted in FIG. 4C.

FIG. 4C" shows another embodiment of the resilient ring structure depicted in FIG. 4C.

FIG. 4D shows a portion of a cross-sectional view similar to the view in FIG. 3 revealing an alternative embodiment of the tamper-resistant closure assembly as shown in FIG. 1A.

FIG. 4E shows a portion of a cross-sectional view similar to the view in FIG. 3 revealing yet another embodiment of the tamper-resistant closure assembly as shown in FIG. 1A.

In FIG. 13B, the container is opened to reveal several storage compartments.

In FIG. 13C, the container is closed.

DETAILED DESCRIPTION

The following describes various innovative principles related to tamper-resistant closures and enclosures. Aspects of disclosed subject matter pertain to tamper-resistant containers and closure assemblies for storing cigarettes. Therefore, with tamper-resistant closures and containers being but examples of disclosed subject matter used for illustrative purposes, some disclosed containers are configured to hold one cigarette. Other containers are configured to receive one or more such containers, and thereby to hold or store a plurality of cigarettes. Still other embodiments of disclosed containers can include components or accessories for making, storing, and/or facilitating consumption of cigarettes.

As noted, embodiments of tamper-resistant closures and containers described in context of storing cigarettes are, but particular examples of contemplated tamper-resistant closures and containers chosen as being convenient illustrative examples of disclosed principles. One or more of the disclosed principles can be incorporated in various other tamper-resistant closures and enclosures for storing other objects and/or materials, such as, for example, medicine, medical devices, nutrition supplements, food, tools, and so on. Accordingly, such alternative embodiments also fall within the scope of this disclosure.

I. Tamper-Resistant Cap

Figure 1B:
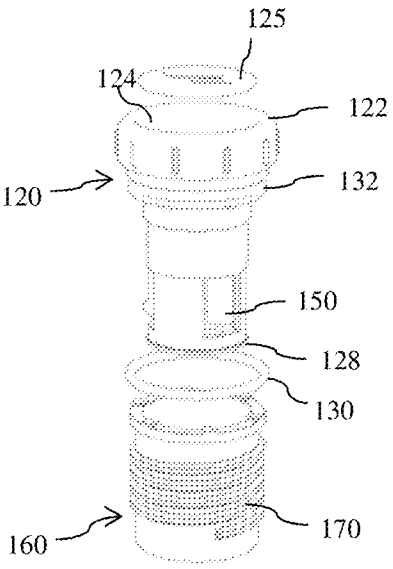
FIG. 1B shows an exploded view of the tamper-resistant closure assembly shown in FIG. 1A.
Figure 1A:
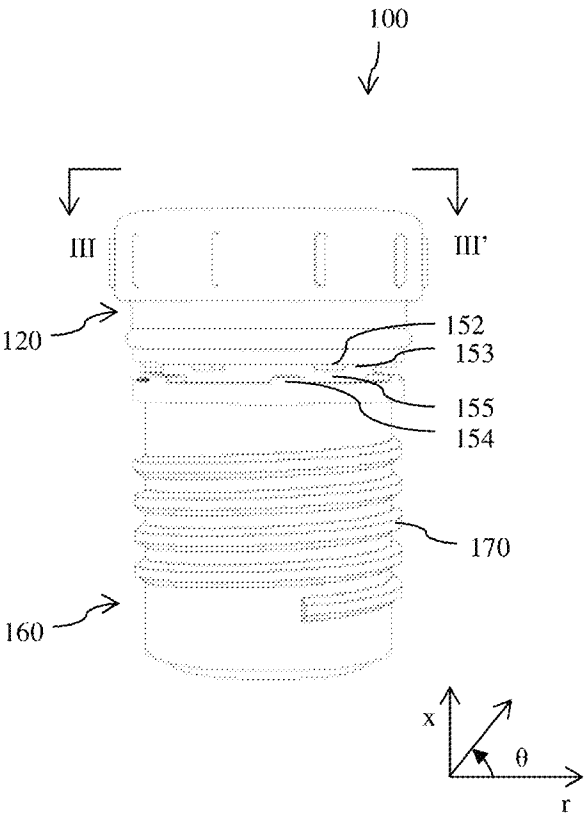
FIG. 1A shows a side elevation of one embodiment of a tamper-resistant closure assembly having an elongate body coupled with a complementary ferrule.

FIGS. 1A and 1B show a tamper-resistant closure assembly, or cap 100. An elongate body 120 rests within an overlying, complementarily configured ferrule 160. As shown in FIG. 1A, the body 120 is at rest in a longitudinally expanded position relative to the ferrule 160. Stated differently, the cap 100 is configured to bias, or urge, the elongate body 120 and ferrule 160 longitudinally apart from each other within a selected, limited range of motion along the x-axis in FIG. 1A. The externally threaded ferrule 160 is generally free to rotate circumferentially of the elongate body 120 when in the expanded at-rest position shown in FIG. 1A. When the elongate body 120 and the ferrule 160 are longitudinally urged together, and the elongate body 120 and ferrule 160 are rotated relative to each other, the complementarily arranged bosses 152, 154 positioned on the elongate body 120 and ferrule 160, respectively, urge against each other to prevent circumferential rotation of the elongate body 120 relative to the ferrule 160. Thusly, the elongate body 120 and ferrule 160 can be made to rotate together in unison when a user presses the elongate body 120 longitudinally and urges the elongate body 120 in rotation. However, absent longitudinal urging, the bosses, or teeth 152, 154 do not engage. Thus, if the elongate body 120 is urged in rotation without engaging the teeth 152, 154 with each other, the elongate body 120 will remain free to rotate relative to the ferrule 160, providing a measure of resistance to opening of a container into which the ferrule 160 is threadably received (e.g., FIGS. 5B and 6A) by those lacking the skill or deftness to urge the elongate body 120 longitudinally of the ferrule 160 to urge the teeth 152, 154 into engagement and simultaneously to urge the cap 100 in rotation (θ-direction motion). The elongate body 120 and/or the ferrule 160 can be made of any type of metal (e.g., aluminum), alloy, plastic, or other types of materials.

The Elongate Body

Figure 2B:
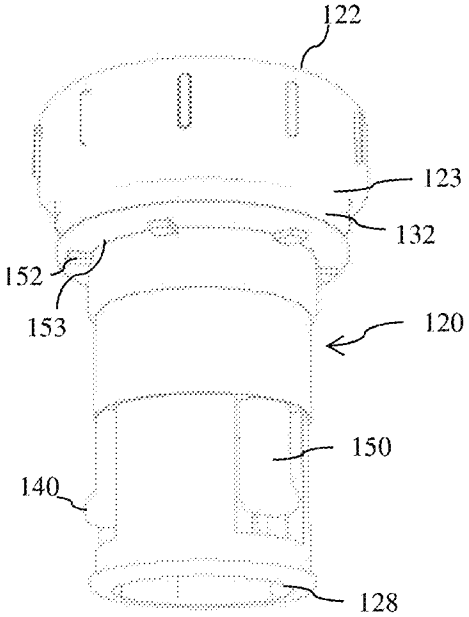
FIG. 2B shows a perspective view from below the elongate body shown in FIGS. 1B and 2A.
Figure 2A:
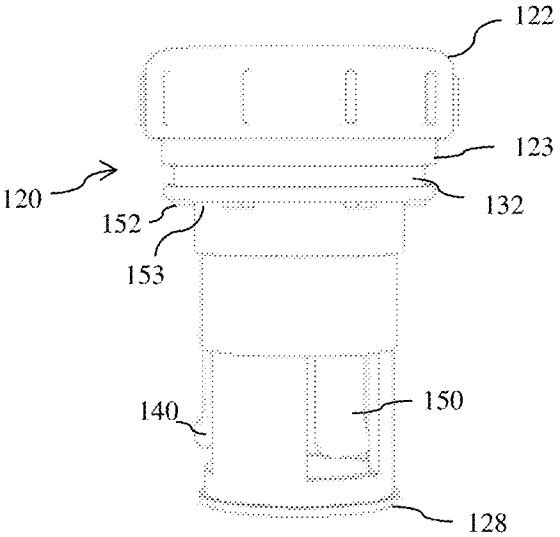
FIG. 2A shows a side elevation of an elongate body as shown in FIG. 1B.

Referring to FIGS. 1A, 2A, and 2B, the elongate body 120 has a proximal end 122 and a distal end 128. The proximal end 122 can have a recessed region 124 that can be configured to receive a complementarily sized insert 125. A top surface of the insert 125 can be decorated to display logos, ornamentation, or other graphical and/or textual information.

Figure 5A:
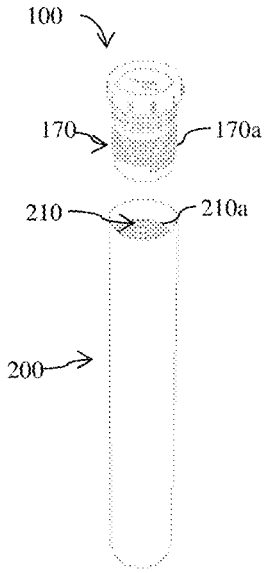
FIG. 5A shows an exploded view of a tamper-resistant container incorporating a tamper-resistant closure assembly as shown in FIGS. 1A, 4A, 4B, and 4C and a complementarily configured sheath.

An external major surface 123 of the elongate body 120 can define a circumferentially extending recess or groove 132 configured to receive a complementarily sized seal member or gasket 130. As shown in FIG. 1B, the seal member 130 can be arranged as an O-ring and can be made of a suitable sealing material, such as, for example, a pliant rubber, silicone, or other polymer suitable for providing a water resistant and/or air-tight seal between the external surface 123 of the elongate body 120 and an interior surface of a container (or sheath 200, FIG. 5A, 5B).

Figure 3:
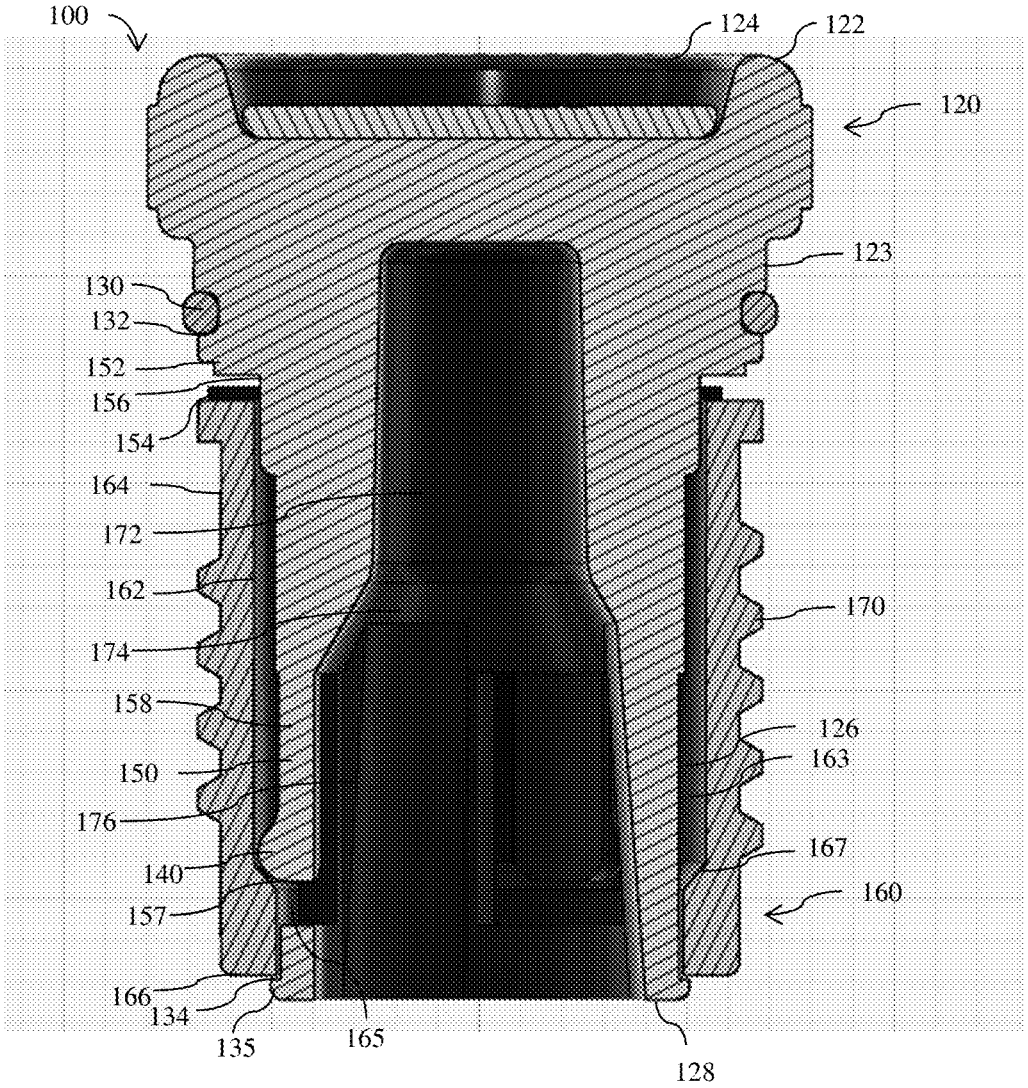
FIG. 3 shows a longitudinal cross-section of the tamper-resistant closure assembly taken along section line III-III' in FIG. 1A.
Figure 7C:
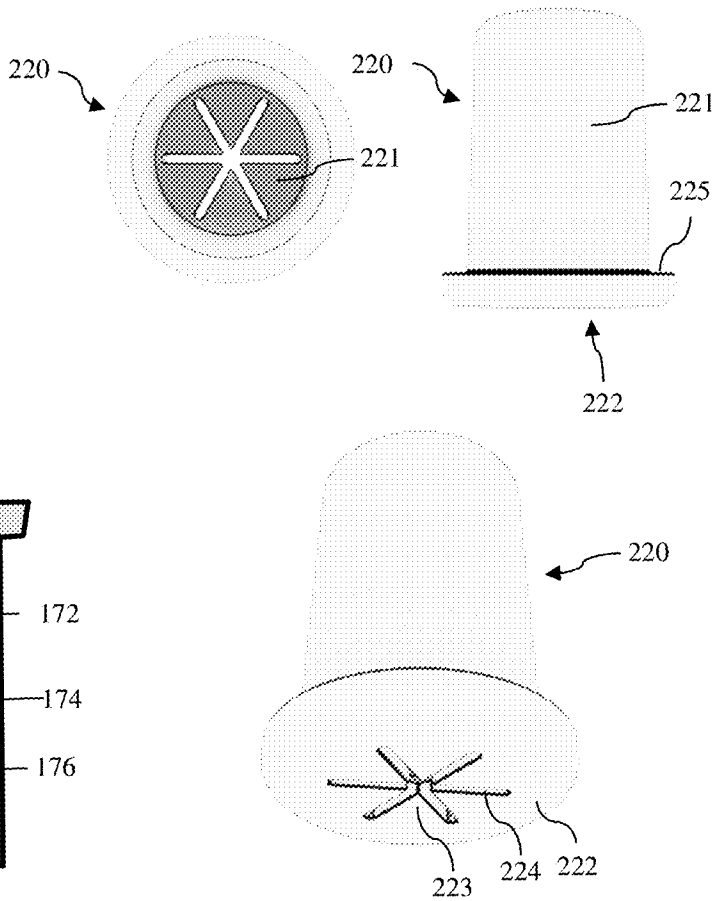
FIG. 7C shows a bottom plan view, a side elevation view, and an isometric view of an insert having a fluted aperture defining a plurality of resilient flaps for retaining a variety of sizes of a cigarette.
Figure 7B:
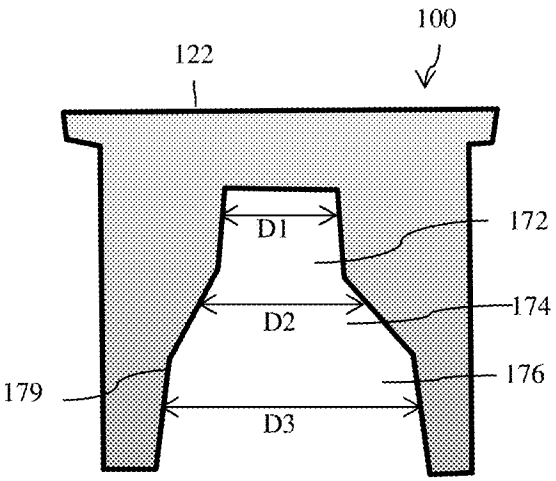
FIG. 7B shows a longitudinal cross-section view of an inverted tamper-resistant closure assembly supporting a cigarette.
Figure 7A:
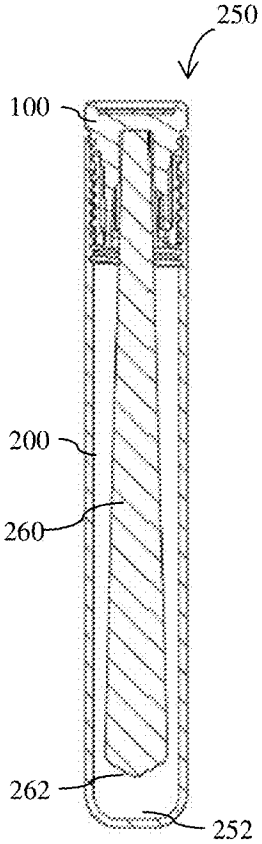
FIG. 7A shows a longitudinal cross-section of the container depicted in FIG. 6A with a cigarette securely retained by the tamper-resistant closure assembly.

Referring now to FIG. 3, some embodiments of the elongate body 120 can define a first recessed region 172 and a second recessed region 176 joined together by a transition region 174. The transverse cross-section of each respective region (e.g., taken transversely to the x-axis in FIG. 1A, as in the r-θ plane) can have a circular or polygonal shape. Each respective region can be complementarily sized to matingly receive a correspondingly sized suction-end of a cigarette 260, as illustrated by way of example in FIG. 7A. In a particular working embodiment, the first recessed region 172 has a transverse cross-sectional dimension D1 (FIG. 7B) measured about 4.8 mm (e.g., between about 4.4 mm and about 5.2 mm, such as between about 4.7 mm and about 4.9 mm) so as to matingly receive a "super-slim" cigarette. In the working embodiment, the second recessed region 176 has a transverse cross-sectional dimension D3 measuring about 7.9 mm (e.g., between about 7.3 mm and about 8.5 mm, such as between about 7.8 mm and about 8.0 mm) so as to matingly receive a "king size" cigarette. The transition region 174 can have transverse cross-sectional dimension D2 measuring about 5.2 mm (e.g., between about 4.9 mm and about 5.5 mm, such as between about 5.1 mm and about 5.3 mm) so as to receive a "standard size" cigarette. As shown in FIG. 7A, the cap 100 can matingly receive a suction end of a cigarette 260 in the recess 172, 174, 176 to retain the cigarette 260. When a sheath 200 overlies that cap and cigarette assembly, the cigarette 260 can be suspended in the sheath 200, as in FIG. 7A. By suspending or otherwise retaining the cigarette 260 within the sheath 260, a likelihood of damage to the cigarette 260, as during shipping, storing, or transporting, can be reduced. Alternatively, when the cap 100 is removed from the sheath 200, the tamper-resistant closure assembly 100 can be inverted (see e.g., FIG. 7B) to be used as a cigarette stand to stably and securely hold a full or partially consumed cigarette between intermittent uses and before the cap-and-cigarette assembly is returned to the sheathed storage arrangement shown in FIG. 7A.

In some embodiments, the interior surface 179 (or portion thereof) of any of the regions 172, 174, 176 can have a grooved texture, and/or be coated with or made in whole or part of a plastic sheath, such as, for example, a molded polyurethane or rubbery pliant material to provide a secure frictional engagement and/or interference fit between the interior surface 179 and a cigarette received in the recess. FIG. 7C shows a bottom plan view, a side elevation view, and an isometric view of a sheath suitable to be inserted in or otherwise received by a recessed region 172, 174, and/or 176 (FIG. 7B). The sheath insert has a fluted aperture 224 defining a plurality of resilient flaps 223 for retaining a variety cigarette sizes. As a user inserts a butt-end of a cigarette in the fluted aperture 224, the resilient flaps deflect inwardly of the body 221 of the sheath 220. The flaps, being resilient, urge inwardly against the butt-end of the cigarette, and frictional engagement between the flaps and the cigarette body retains the cigarette, generally as shown in FIG. 7A. The illustrated sheath insert 220 has a shoulder 225 to urge against the distal end 128 of the elongate body 100. A distal face 222 of the insert 220 faces outwardly of the recessed region 172, 174, and/or 176. The body 221 of the sheath 220 can matingly engage with or be deposited on an inner major surface of the recess 172, 174, and/or 176. In some sheath embodiments, a grommet or other pliant member matingly engages a distal region of the elongate body 100 and defines a fluted or other aperture having one or more resilient flaps 223. The fluted or other aperture can receive a butt-end of a cigarette as described above. The one or more flaps 223 can be integrally formed as part of the elongate body 100 or can be formed as a portion of a separate member that matingly engages the elongate body.

In some embodiments, the interior surface 179 of any of the respective regions 172, 174, 176 can be longitudinally tapered to define a longitudinally decreasing cross-section dimension moving from the distal end 128 toward the proximal end 122 of the elongate body 120. Such a taper can enhance an interference fit or other mating engagement with a cigarette received therein. A degree of taper may vary among the different regions. For example, in the embodiment shown in FIG. 3, the transition region 174 has a higher degree of taper than either of the first recess region 172 and the second recess region 176. The longitudinal dimension of each respective region 172, 174, 176 can also be selected to accommodate different lengths of a cigarette's suction-end.

The Ferrule

Referring to FIG. 3, the ferrule 160 can define an interior major surface 162 and an exterior major surface 164. The interior major surface 162 defines a generally hollow tubular structure that can include a proximal region 163 and a distal region 165. A transverse cross-section of the proximal region 163 and/or the distal region 165 can have a circular or a polygonal shape. In addition, the proximal region 163 and/or the distal region 165 can be complementarily sized and shaped to corresponds with an elongate body 120 received within the ferrule 160, as illustrated in FIGS. 3, 4A, 4B, and 4C, and described more fully below.

In some embodiments, the proximal region 163 can have a larger transverse cross-sectional dimension than a corresponding transverse cross-sectional dimension of the distal region 165. In the embodiment shown in FIG. 3, a sloped face 167 can be positioned between the proximal region 163 and the distal region 165 to provide a transition between the regions. Alternatively, the proximal region 163 may have the same or a comparably sized transverse cross-sectional dimension as the distal region 165.

Coupling Between the Elongate Body and the Ferrule

As noted above, the elongate body 120 can be slidably retained within the ferrule 160 by a shoulder 135 extending radially outward of the distal end 128 of the elongate body 120. As illustrated in FIG. 3, in some embodiments, the shoulder 135 can be positioned at or adjacent the distal end 128 of the elongate body 120. Accordingly, a longitudinally facing face 134 of the shoulder 135 can abut a distal end 166 of the ferrule 160 so as to retain the elongate body 120 longitudinally within the ferrule 160 to limit an extent of longitudinal separation between the teeth 152, 154 positioned at the proximal end region.

Alternatively, the shoulder 135 can be positioned between the opposed ends 122, 128 of the elongate body 120, as illustrated in FIG. 4C. In FIG. 4C, the interior major surface 162*c* of the ferrule 160*c* has a recessed region 161*c* sized and positioned in correspondence with the outwardly extending shoulder 135*c* of the elongate body 120*c*. Accordingly, the shoulder 135*c* can be received by and stably anchored within the proximal and distal extents of the corresponding recessed region 161*c* defined by the ferrule 160*c* after the elongate body 120*c* and the ferrule 160*c* are assembled (as by urging them together longitudinally).

Engagement Between the Elongate Body and the Ferrule

A resilient biasing member can resiliently urge the elongate body 120 and the ferrule 160 longitudinally of each other to longitudinally separate the teeth 152, 154. As described more fully below, the biasing member and a complementary surface or other structure arranged to urge the body 120 and the ferrule 160 apart from each other can take many forms. With such a biasing member, when no external force is applied to the proximal end 122 of the elongate body 120, the elongate body 120 rests in a raised position relative to the ferrule 160 (see e.g., FIG. 3). In such a raised position, the teeth 152, 154 do not engage each other and rotation of the elongate body 120 will not cause corresponding rotation of the ferrule 160 when the ferrule 160 is threadably retained in a sheath 200. On the other hand, when a downward force is applied to the proximal end 122 of the elongate body 120, the elongate body 120 can move longitudinally of the ferrule 160 to a lowered position. In such a lowered position, the teeth 152 of the elongate body 120 can urge against and rotationally engage the corresponding teeth 154 of the ferrule 160. In that arrangement, concurrent rotation of the elongate body 120 (clockwise or counterclockwise) can urge the ferrule 160 in a corresponding rotation.

The teeth 152, 154 can have a variety of configurations. In some embodiments, the elongate body 120 can define a first plurality of juxtaposed teeth 152 spaced apart from each other to define a first plurality of juxtaposed recesses 153 therebetween. The ferrule 160 can further define a second plurality of juxtaposed teeth 154 spaced apart from each other to define a second plurality of juxtaposed recesses 155 therebetween. The first plurality of juxtaposed teeth 152 can be complementary to the second plurality of juxtaposed recesses 155, and the second plurality of juxtaposed teeth 154 can be complementary to the first plurality of juxtaposed recesses 153. Thus, when the elongate body 120 moves to the lowered position as by applying a force to the proximal end 122, the first plurality of juxtaposed teeth 152 can be respectively received by the corresponding second plurality of recesses 155, and the second plurality of juxtaposed teeth 154 can be respectively received by the corresponding first plurality of recesses 153. Accordingly, rotating the elongate body 120 can engage the ferrule 160, causing the rotation of the tamper-resistant closure assembly 100 relative to, for example, a sheath 200.

Automatic Disengagement of the Elongate Body from the Ferrule

Under an internal force applied by the biasing member, when the force at the proximal end 122 is released, the elongate body 120 can automatically move longitudinally upward to the raised position shown in FIG. 3 so as to disengage its teeth 152 from the teeth 154 of the ferrule 160. The first plurality of juxtaposed teeth 152 and the corresponding recesses 153 can disengage the complementary second plurality of juxtaposed recesses 155 and the corresponding teeth 154.

As illustrated in FIG. 3, the tamper-resistant closure assembly 100 can include a boss 140 positioned adjacent the distal end 128 of the elongate body 120. The boss 140 is configured to urge resiliently outwardly against the interior major surface 162 of the ferrule 160. As FIG. 3 shows, the ferrule 160 can define a region 167 so complementarily arranged relative to the boss 140 as to resiliently urge the elongate body 120 in a proximal direction relative to the ferrule 160 in correspondence with a radially outward force applied by the boss 140 against the interior major surface 162. Alternatively, as shown in FIGS. 4D-4E and described more fully below, the ferrule can also define a resilient biasing member that is complementarily arranged relative to a structural element of the elongate body so as to resiliently urge the elongate body in a proximal direction relative to the ferrule in correspondence with a radially inward force applied by the resilient biasing member against the elongate body.

For example, FIG. 3 shows an embodiment where the boss 140 is positioned adjacent a distal end of a cantilevered spring lever, or cantilever 150. The proximal end 156 of the cantilever 150 has a unitary construction with the elongate body 120, and a body of the cantilever 150 between the proximal end 156 and a free distal end 157 is spaced from the wall 126 of the elongate body 120 as to define a distally extending arm 158 free to deflect in a radial direction relative to the wall 126 of the elongate body 120 and the ferrule 160. As the region 167 urges against the boss 140 to deflect the free distal end 157 of the cantilever radially inward, a restorative outward force is applied by the boss 140 to the region 167. When a user releases a longitudinal force from the proximal end 122, the slope of the region 167 can urge the boss 140, and thus the elongate body 120, longitudinally under the radially outward restorative force arising from a radially inward deflection of the cantilever 150. The cantilever 150 can be made of any types of spring resilient material so that the cantilever 150 urges toward a biased position (e.g., a radially inward position) by applying an external force and the cantilever 150 resiliently urges toward an unbiased position when the external force is removed.

Figure 6C:
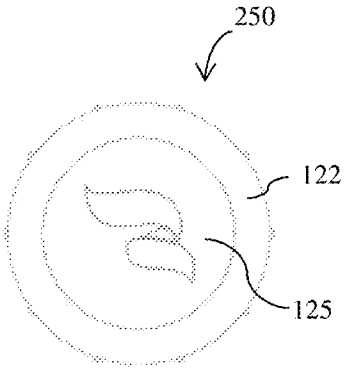
FIG. 6C shows a top plan view of the tamper-resistant closure assembly shown in FIGS. 1A, 1B and 3.
Figure 6B:
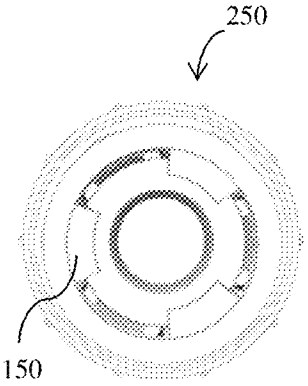
FIG. 6B shows a bottom plan view of the tamper-resistant closure assembly shown in FIGS. 1A, 1B and 3.

In some embodiments, one or more spring levers 150 can be distributed circumferentially around the elongate body 120. For example, FIG. 6B shows three spring levers 150 uniformly distributed around the elongate body 120. The number of spring levers 150 can vary from three, and the spring levers can be distributed asymmetrically and/or non-uniformly. As illustrated in FIG. 3, when the elongate body 120 is in the raised position relative to the ferrule 160, the boss 140 can rest against the sloped face 167 positioned between the proximal region 163 and the distal region 165. The boss 140 can be moved toward the distal region 165 as it slides along the sloped face 167, as when the elongate body 120 moves toward the lowered position under an external force as the boss 140 moves distally, the free distal end 157 of the cantilever 150 is pushed radially inward. An interface force between the sloped face 167 and the boss 140 has both radial and longitudinal vector components. Thus, as the boss 140 on the spring lever 150 urges radially outward under a resilient restorative force, the elongate body 120 is urged toward the proximal region 163 and into the raised position when the external force on the proximal end 122 is released.

Alternative Embodiments of the Boss and Related Structure

The following describes several alternative, but non-limiting, embodiments of the structure configured to resiliently engage and disengage the elongate body 120 and the ferrule 160.

Referring to FIG. 4A, an inner major surface 162*a* of a ferrule 160*a* can define a recessed area 168*a* positioned between the proximal region 163*a* and the distal region 165*a*. Proximally of the recessed area 168*a*, the proximal region 163*a* can have a larger, a smaller, or a similar transverse cross-sectional dimension and/or shape compared to a transverse cross-section of the distal region 165*a*. A sloped face 167*a* can define a transition zone between the recessed area 168*a* and for example the distal region 165*a*. When the elongate body 120*a* is in the raised position relative to the ferrule 160*a*, the boss 140*a* can rest against the sloped face 167*a*. As with the arrangement in FIG. 3, the boss 140*a* can be urged toward the distal region 165*a* under an external force applied to the proximal end. As the boss 140*a* moves distally, the sloped face 167*a* urges the boss 140*a* inward radially. When the external force is released, the boss 140*a* can move radially outwardly and urge the elongate body 120*a* to the raised position under a resilient, restorative force arising from a deflection of the material surround the boss 140*a*.

Referring to FIG. 4B, another embodiment is shown and described. In this example, an inner major surface 162*b* of another ferrule 160*b* defines an inwardly protruding shoulder 169*b* positioned between the proximal region 163*b* and the distal region 165*b*. Proximally of the inwardly protruding shoulder 169*b*, the proximal region 163*b* can have a larger, a smaller, or a similar transverse cross-sectional dimension and/or shape compared to the cross-section of the distal region 165*b*. The shoulder 169*b* can define a curved or rounded face 169*b*' defining an interface between the inwardly protruding shoulder 169*b* and the boss 140*b*. When the elongate body 120*b* is in the raised position relative to the ferrule 160*b*, the boss 140*b* can rest atop the inwardly protruding shoulder 169*b*. The boss 140*b* can be urged toward the distal region 165*b* as it slides across the face 169*b*' under downward external force, as can be applied to the proximal end. The boss 140*b* can expand radially outwardly and move back toward the proximal region 163*b* under a restorative, resilient force arising from material deflections. Such radial movement of the boss 140*b* can urge the elongate body 120*b* toward the raised position when the external force on the proximal end is released.

FIG. 4C shows yet another embodiment. In this example, a resilient ring structure 140*c* can apply a resilient, restorative force to the elongate body 120*c*. For example, the resilient ring structure 140*c* can be a C-ring 140*c*', as illustrated in FIG. 4C', which can be made of a resiliently deformable material. In another example, the resilient ring structure 140*c* can be a spiral ring 140*c*", as illustrated in FIG. 4C", which can be resiliently compressed. The resilient ring structure 140*c* can be positioned distally of the distal end 128*c* of the elongate body 120*c* within the ferrule 160*c*. In some instances, the resilient ring structure 140*c* can form part of the elongate body 120*c* or ferrule 160*c*, and in other instances, the resilient ring structure 140*c* can be a separate component. As illustrated in FIG. 4C, a sloped face 167*c* can be positioned between the proximal region 163*c* and the distal region 165*c*. When the elongate body 120*c* is in the raised position relative to the ferrule 160*c*, the resilient ring structure 140*c* can rest against the sloped face 167*c*. The resilient ring structure 140*c* can be urged toward the distal region 165*c*. As it slides down the sloped face 167*c*, the resilient ring structure 140*c* compresses radially, as under an external force applied to the proximal end of the elongate body 120*c*. Under the resilient, restorative force arising from compression of the resilient ring structure 140*c*, the resilient ring structure 140*c* can expand radially outward when the external force is released. Such radial expansion along the sloped face 167*c* urges the resilient ring structure 140*c* proximally. As the elongate body 120*c* rests against the resilient ring structure 140*c*, proximal movement of the resilient ring structure 140*c* tends to urge the elongate body 120*c* proximally of the ferrule 160*c*.

Referring to FIG. 4D, an inner major surface 162*d* of a ferrule 160*d* can define a cantilevered arm 169*d* positioned between the proximal region 163*d* and the distal region 165*d*. The cantilevered arm 169*d* can have a proximal end 168*d* affixed to the inner major surface 162*d* of the ferrule 160*d* and a free distal end 167*d* spaced from the inner major surface 162*d*. The cantilevered arm 169*d* can be made of resilient spring material. Proximally of the cantilevered arm 169*d*, the proximal region 163*d* can have a larger, a smaller, or a similar transverse cross-sectional dimension and/or shape compared to a transverse cross-section of the distal region 165*d*. A sloped face 140*d* (or alternatively a protruding shoulder 140*b* as shown in FIG. 4B) can define an interface with the cantilevered arm 169*d*. When the elongate body 120*d* is in the raised position relative to the ferrule 160*d*, the sloped face 140*d* can rest against the cantilevered arm 169*d* adjacent its proximal end 168*d*. The sloped face 140*d* can be urged toward the free distal end 167*d* of the cantilevered arm 169*d* under an external force applied to the proximal end of the elongate body 120*d*. As the sloped face 140*d* moves distally, the sloped face 140*d* urges the cantilevered arm 169*d* outward radially. When the external force is released, the cantilevered arm 169*d* can move radially inwardly under a resilient, restorative force arising from a deflection of the cantilevered arm 169*d*, thus urging the sloped face 140*d* toward the proximal end 168*d*, and urging the elongate body 120*d* to the raised position.

Referring to FIG. 4E, an inner major surface 162*e* of a ferrule 160*e* can define a deformable protrusion 169*e* positioned between the proximal region 163*e* and the distal region 165*e*. The deformable protrusion 169*e* can have a proximal end 168*e* and a distal end 167*e*, each end being affixed to the inner major surface 162*e* of the ferrule 160*e*. The deformable protrusion 169*e* can be made of resilient spring material. Proximally of the deformable protrusion 169*e*, the proximal region 163*e* can have a larger, a smaller, or a similar transverse cross-sectional dimension and/or shape compared to a transverse cross-section of the distal region 165*e*. An outwardly extending shoulder 140*e* (or alternatively a sloped face 140*d* as shown in FIG. 4D) can define an interface with the deformable protrusion 169*e*. When the elongate body 120*e* is in the raised position relative to the ferrule 160*e*, the shoulder 140*e* can rest atop the deformable protrusion 169*e* adjacent its proximal end 168*e*. The shoulder 140*e* can be urged toward the distal end 167*e* of the deformable protrusion 169*e* under an external force applied to the proximal end of the elongate body 120*e*. As the shoulder 140*e* moves distally, the shoulder 140*e* urges the deformable protrusion 169*e* outward radially. When the external force is released, the deformable protrusion 169*e* can move radially inwardly under a resilient, restorative force arising from a deflection of the deformable protrusion 169*e*, thus urging the shoulder 140*e* toward the proximal end 168*e*, and urging the elongate body 120*e* to the raised position.

Sheaths

Figure 5B:
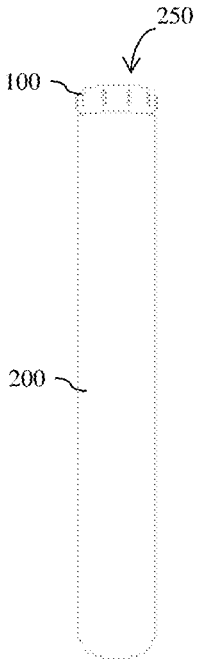
FIG. 5B shows a side elevation view of the container shown in FIG. 5A in a closed arrangement.
Figure 6A:
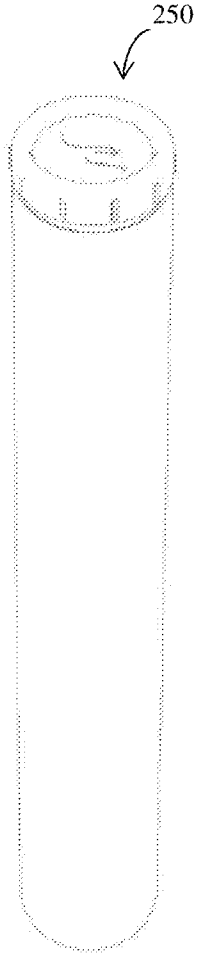
FIG. 6A shows a perspective view from above the container depicted in FIG. 5B.

In some embodiments, the tamper-resistant closure assembly 100 can also include an external engagement member 170 configured to matingly engage a sheath 200, or other containment body, or enclosure. In some embodiments, the external engagement member 170 can be disposed on or extend from the exterior major surface 164 of the ferrule 160. The external engagement member 170 can be configured to removably couple with a complementarily arranged region 210 of the sheath 200. In some embodiments, the external engagement member 170 can include an external thread 170*a* and the complementarily arranged region 210 of the sheath 200 can include an internal thread 210*a* that is complementary to the external thread 170*a* to allow the cap 100 to threadably engage with the sheath 200. Thus, the tamper-resistant closure assembly 100 threadably engages with the sheath 200 to form a closed, tamper-resistant container 250 (FIG. 5B).

With embodiments described above, the elongate body 120 can rotationally engage the ferrule 160 when the elongate body 120 is pressed to a lowered position. In addition, when force is relieved from the proximal end 122 of the elongate body 120, the elongate body 120 can automatically urge upward and disengage from the ferrule 160. Thus, to close or open the container 250, a user generally must press the elongate body 120 downward and rotate it clockwise or counterclockwise to rotationally engage the elongate body 120 with the ferrule 160 and to threadably engage or disengage the cap 100 with or from the sheath 200. When the downward force is removed, the elongate body 120 can disengage from the ferrule 160, so that rotating the elongate body 120 will not cause corresponding rotation of the ferrule 160, thus disabling a threadable rotation of the ferrule 160 relative to the sheath 200, and thus of the tamper-resistant closure assembly 100 within the sheath 200. Accordingly, the tamper-resistant closure assembly 100 may prevent inadvertent opening of the container 250 by those lacking the skill and/or dexterity to simultaneously urge the elongate body 120 longitudinally and circumferentially.

Referring FIG. 7A, a longitudinal dimension of the sheath 200 can be slightly longer than the greatest anticipated length of an intended cigarette (e.g., a super slim sized cigarette). Thus, when a cigarette 260 is stored in the container 250, a suction-end of the cigarette 260 can be securely received in any of the recess regions 172, 174, 176 of the elongate body 120, and the other end 262 of the cigarette 260 can be prevented from touching the distal end 252 of the sheath 200. The transverse cross-section dimension of the sheath 200 can be slightly larger than a circumferential dimension of the cigarette 260 so that the cigarette 260 does not touch an inner major surface of the sheath 200. Accordingly, the cigarette 260 can be securely stored inside the container 250, without getting damaged by touching the bottom or inner surface of the container 250 even during abrupt movement or when the container 250 is dropped from a selected height to the ground.

As described above, the tamper-resistant closure assembly 100 can include a seal member 130. When the external engagement member 170 is coupled with the complementarily arranged region 210 of the sheath 200, the seal member 130 can extend from an external surface 123 of the elongate body 120 to a corresponding internal surface of the sheath 200 to sealingly engage the sheath 200. Accordingly, the container 250 can be in some instances, air and/or water resistant, hermetically sealed, and in other instances so as to maintain freshness of the herbaceous cigarette stored therein, e.g., by protecting it from the sunlight and changes in humidity. In addition, the seal member 130 may be color coded so that it allows a user to recognize and classify different types of cigarettes without the need to take it out of the container 250.

II. Other Tamper-Resistant Containers

FIGS. 8A through 13 show alternative embodiments of tamper-resistant containers. Some of the containers may contain one or more tamper-resistant containers 250 described above for storing cigarettes, and may also incorporate one or more other smokers' accessories, such as, for example, a cleaner, a lighter, a grinder, a storage container for herbaceous material, package of rolling papers, etc., so that a user may carry necessary or desirable elements in one discreet and convenient package.

Latched Tamper-Resistant Container

Figure 8A:
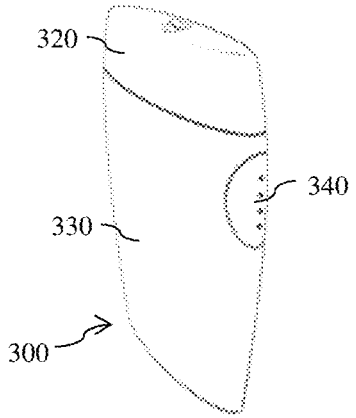
FIG. 8A shows a perspective view from above another embodiment of a tamper-resistant container.
Figure 8B:
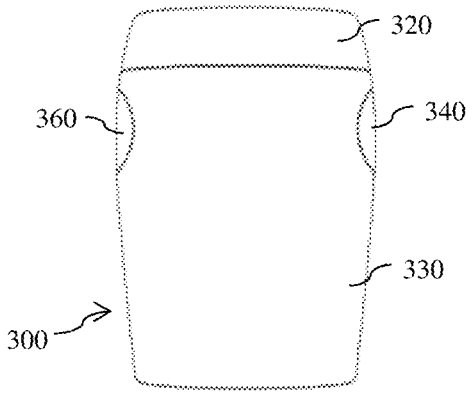
FIG. 8B shows a front elevation view of the tamper-resistant container depicted in FIG. 8A.
Figure 8C:
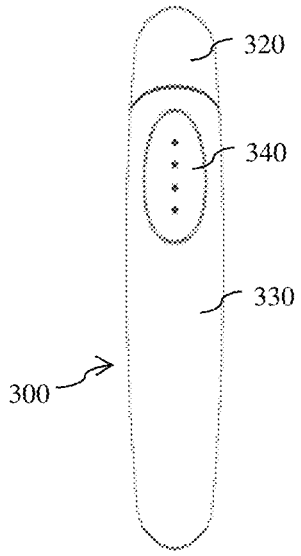
FIG. 8C shows a side elevation view of the tamper-resistant container depicted in FIG. 8A.
Figure 9:
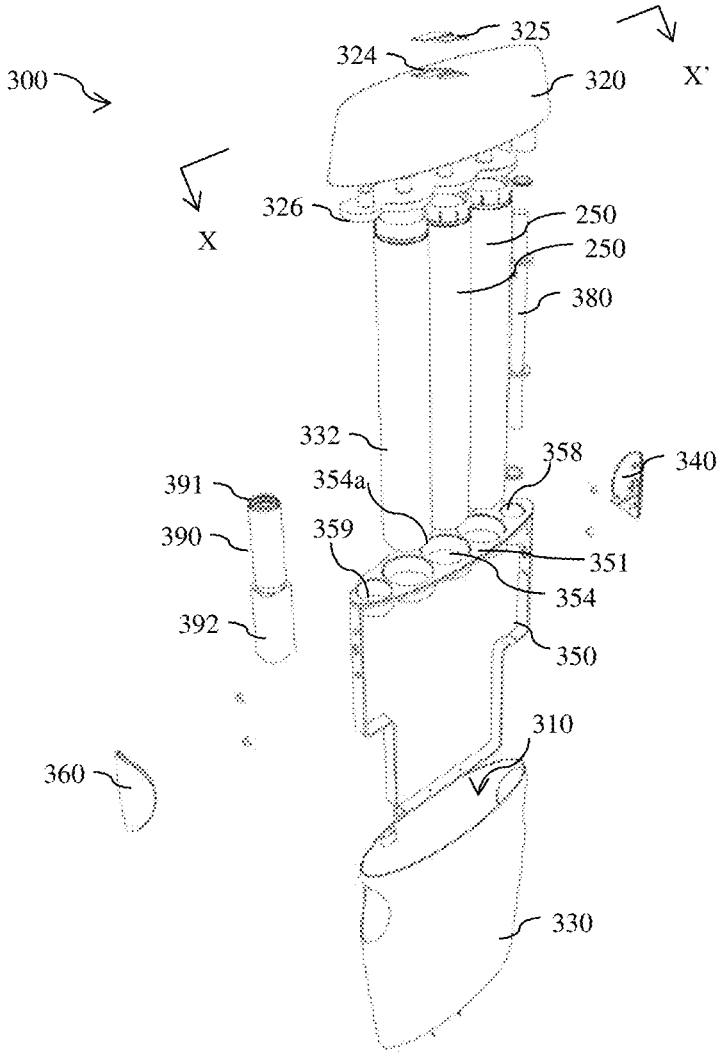
FIG. 9 shows an exploded view of the tamper-resistant container depicted in FIG. 8A.
Figure 10B:
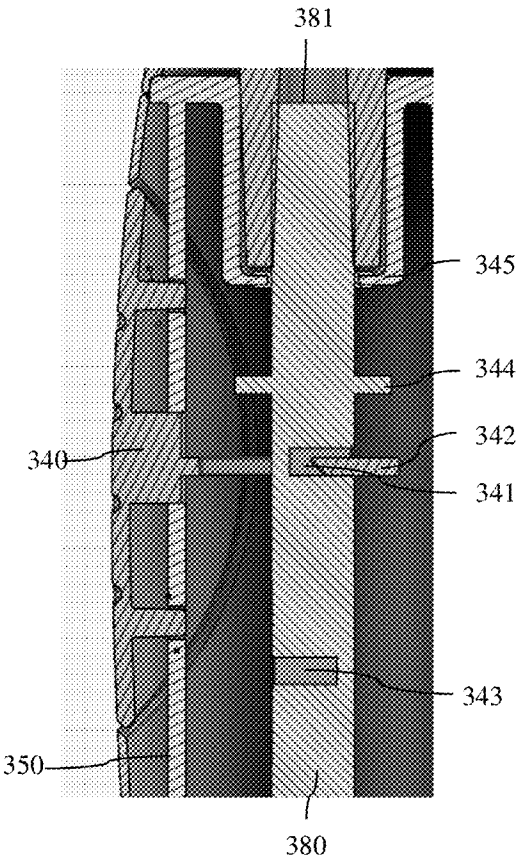
FIG. 10B shows an enlarged view of a portion of the vertical shaft and the latch depicted in FIG. 10A.
Figure 10A:
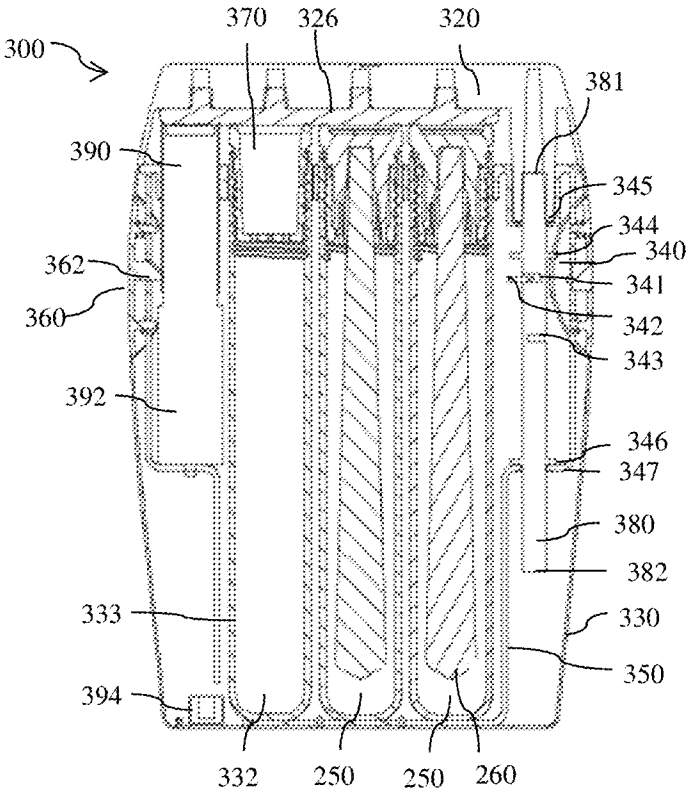
FIG. 10A shows a longitudinal cross-section view of the tamper-resistant container depicted in FIG. 8A taken along line X-X'.

FIGS. 8A-8C show different views of a tamper-resistant container 300 and FIGS. 9, 10A and 10B show aspects of several associated structural components.

The tamper-resistant container 300 can include a cap 320, an interior frame or chassis 350, and a body cover, or case 330 defining an interior compartment 310 that slidably receives the interior frame 350. The body cover 330 can be complementarily arranged relative to the cap 320 to enclose the compartment 310 when the cap 320 covers a top opening of the compartment 310. In some embodiments, an upper region of the cap 320 can define a recessed region 324 configured to receive a complementarily sized insert 325. The insert can be decorative and/or convey information, such as ornamentation, branding, content, or type of cigarette, etc. For example, a top surface of the insert 325 can display logos or other graphical and/or textual information.

The interior frame 350 can have an upper plate 351 defining a plurality of apertures 354*a*, each configured to slidably receive a container 250. In some embodiments, a receptacle 354 can be positioned in correspondence with each aperture 354*a*. In some embodiments, each receptacle 354 can be complementarily sized and shaped to slidably receive a tamper-resistant container 250 described above. In some embodiments, one receptacle 354 may also be configured to removably receive a cleaner 332 as described more fully below. In certain embodiments, the interior frame 350 may also contain corresponding receptacles 358 and 359 to respectively receive a vertical shaft 380 and a cigarette lighter 390 or another component or accessory, as described in more detail below.

In some embodiments, the container 300 can include a latch 340 and a switch 360. As described more fully below, the switch 360 can be operatively coupled to the lighter 390 to control its operation. The latch 340 can be operated to open and/or close or to retain and release the cap 320 so as to expose or to cover the compartment 310. In addition, the latch 340 and/or the cap 320 can also be operatively coupled to the lighter 390 so as to implement a safety mechanism for the operation of the lighter 390. The latch 340 and the switch 360 may be positioned at opposite sides of the closure assembly 300 as illustrated in FIGS. 8-10, or they may be positioned in another selected region of the body cover 330.

In certain embodiments, the tamper-resistant container 300 can also include a seal member 326 positioned underneath or as part of the cap 320 and over the upper plate 351 of the interior frame 250. The seal member 326 can be made of any known or to be discovered sealing materials, such as rubber, silicone, etc., to provide air-tight and water-resistant properties of the container 300 when the cap 320 is closed.

Each of the above described components, e.g., the cap 320, the body cover 330, the interior frame 350, the latch 340, the switch 360, the shaft 380, etc., can be made of any suitable material, e.g., aluminum, alloy, plastic, or other types of materials.

Latch Mechanism: Vertical Shaft

Referring to FIGS. 10A and 10B, the cap 320 can be affixed to a proximal end 381 of a vertical shaft 380, so as to be cantilevered from the vertical shaft 380 when the cap 320 is opened.

In some embodiments, the shaft 380 can define a first keymate 341 and a second keymate 343. In some embodiments, each keymate 341, 343 is formed by a recessed region on the shaft 380. The first keymate 341 can be positioned longitudinally proximal of the second keymate 343 relative to the cap 320, vertical longitudinal distance between the first keymate 341 and the second keymate 343 can be predefined, e.g., in a range between about ¼ inch to about 1 inch, such as between about ½ inch and about ¾ inch, in correspondence with a desired spacing between the cap 320 and the body cover 330 when the cap 320 is opened. The first keymate 341 and second keymate 343 can be circumferentially offset from each other, as well. The circumferential offset can range between about 20 degrees and about 340 degrees, such as between about 90 degrees and about 270 degrees, with a particular offset being about 180 degrees. Although not shown in the figures, the shaft 380 may contain more than two keymates, and each of the keymates can be longitudinally separated from the others and be circumferentially offset from each of the other keymates.

The shaft 380 can have an outwardly extending shoulder forming an upper stop 344 positioned longitudinally proximal of the first keymate 341, and an outwardly extending shoulder forming a lower stop 346 positioned longitudinally distal of the second keymate 343.

When the shaft 380 is slid proximally along its longitudinal axis, upward movement can be limited by the upper stop 344 engaging or contacting an upper barrier 345 of the interior frame 350. Similarly, when the shaft 380 is longitudinally translated downward (distally), downward movement can be limited by the lower stop 346 engaging or contacting a lower barrier 347 of the interior frame 350.

In certain embodiments, a biased element, e.g., a coil, spring, etc. (not shown) may be positioned circumferentially around a distal end 382 of the shaft 380 to urge against the lower stop 346 so as to urge the shaft 380 upward (proximally). In certain embodiments, a torsion spring (not shown) may be placed around the shaft 380 so as to urge the shaft in rotation about its longitudinal axis.

Latch Mechanism: Latch Arm

Still referring to FIGS. 10A and 10B, the latch 340 can include a key, or latch arm 342 that is complementarily sized and shaped to selectively and matingly engage the first keymate 341 and the second keymate 343. The latch 340 is configured to be movable between a locked position and a released position. The latch 340 is in the locked position when the key 342 matingly engages the first keymate 341 or the second keymate 343, and the latch 340 is in the released position when the key 342 disengages the first keymate 341 or the second keymate 343. Thus, the cap 320 can be locked closed or locked open.

For example, to disengage the key 342 from the respective keymate 341 or 343, the latch 340 can be pushed inwardly relative to an outer major surface of the case 330 so that the key 342 moves away from the shaft 380 and the respective keymate. Accordingly, the shaft 380 becomes unlocked from the key 342, allowing the shaft to freely translate along its longitudinal axis and rotate around the longitudinal axis. By translating vertically and/or rotating angularly the shaft 380, each keymate 341, 343 can be selectively positioned to receive the key 342. Release of the latch 340 can cause the key 342 to move, e.g., laterally outward, to matingly engage the respective keymate 341, 343. Accordingly, the shaft 380 becomes locked by the key 342 so that its longitudinal translation and rotational movement are restricted until the key 342 is removed from the respective keymate 341, 343.

As illustrated in FIGS. 10A and 10B, the shaft 380 can be secured in a closed position with the affixed cap 320 covering the top opening of the compartment 310 when the latch 340 is in the locked position and the key 342 matingly engages the first keymate 341. Stated differently, the longitudinal position and angular orientation of the first keymate 341 can be so configured that when it matingly engages the key 342, the affixed cap 320 is positioned immediately atop the case 330 to cover the compartment 310. Further, the shaft 380 can also be secured in a deployment position (not shown) where the affixed cap 320 is displaced from the top opening of the compartment 310. For example, the latch 340 can be in the locked position and the key 342 can matingly engage the second keymate 343 to retain the cap 320 in an open position. Stated differently, the longitudinal position and angular orientation of the second keymate 342 can be so configured that when the key 342 matingly engages the keymate 342, the affixed cap 320 is positioned to expose the compartment 310. For example, the affixed cap 320 can be raised to a deployment height above the top opening of the compartment and rotated to a deployment angle. The deployment height is about the vertical distance between the first keymate 341 and the second keymate 343, and the deployment angle is about the circumferential offset between the first keymate 341 and the second keymate 343.

In certain embodiments, when the key 342 matingly engages the first keymate 341, the lower stop 346 urges against the lower barrier 347, and when the key 342 matingly engages the second keymate 342, the upper stop 344 urges against the upper barrier 345. Thus, the lower and upper stops 346, 344 and the corresponding lower and upper barriers 347, 345 can be used to restrict a longitudinal extend of translation of the shaft 380 and to facilitate locating the first and second keymates 341, 342, respectively.

Cleaners

In some embodiments, a cleaner, or ember remover 332 can have a sheath 333 that has a substantially similar cross-sectional shape and dimension compared to the sheath 200 of the tamper-resistant container 250 described above. Thus, the sheath 333 of the cleaner may be interchangeably repositioned among the several apertures 354*a*. A receptacle 354 of the interior frame 350 can slidably retain either a tamper-resistant container 250 or a cleaner 332.

Figure 11C:
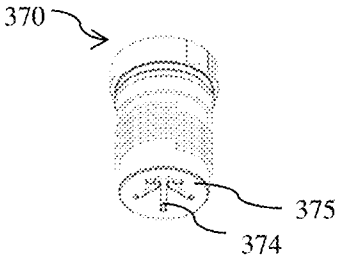
FIG. 11C shows a perspective view from below the ember remover depicted in FIG. 11A.
Figure 11A:
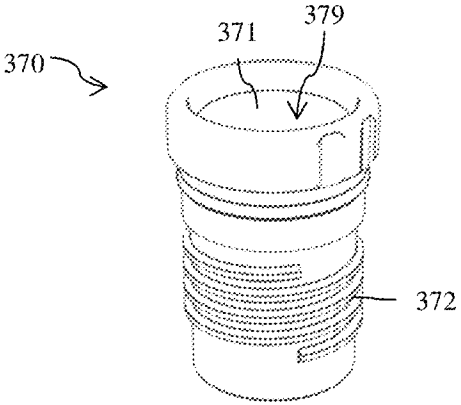
FIG. 11A shows a perspective view from above an externally threaded ember remover.
Figure 11B:
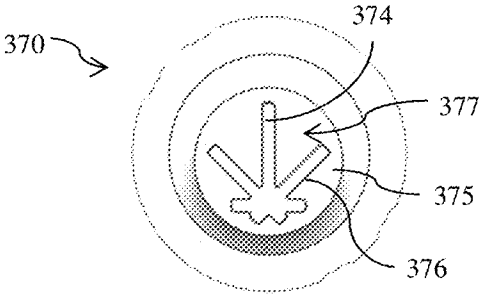
FIG. 11B shows a top plan view of the ember remover depicted in FIG. 11A.
Figure 12:
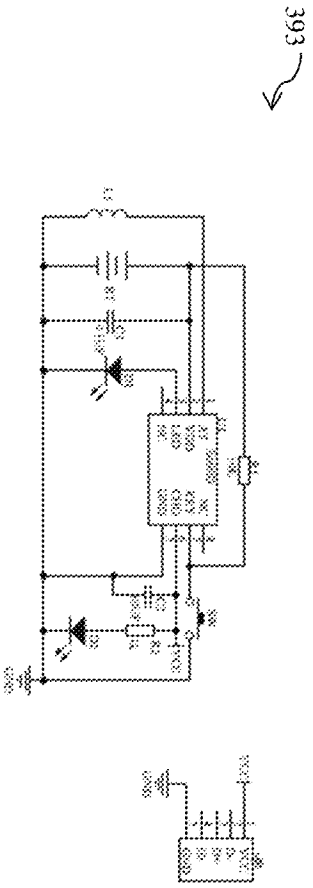
FIG. 12 shows an embodiment of a circuit diagram of a lighter.

In certain embodiments, the cleaner 332 can have a shaft assembly 370. Generally, the shaft assembly 370 can have an external structure similar to an external major surface of the tamper-resistant closure assembly 100 described above. For example, as illustrated in FIGS. 11A-11C, the shaft assembly 370 can have an external thread 372 configured to removably engage an internal thread of the sheath 333.

An internal major surface 371 of the shaft assembly 370 can define an open recess 379. In certain embodiments, a floor 375 of the recess 379 can include a conically recessed region 377 and a plurality of slots 374 extending through the floor 375, thereby defining a plurality of exposed edges 376. In some embodiments, the floor 375 of the recess 379 can include a heat-resistant material, e.g. zinc alloy.

A user may rub smoldering end of a cigarette against the exposed edges 376 on the floor 375 to remove ashes or an ember therefrom. Debris from the cigarette can fall through the slots 374 and into the sheath 333. Thus, the shaft assembly 370 can be used as a cleaning device to remove the ashes of the cigarette before storing a partially consumed cigarette in one of the tamper-resistant containers 250, and the sheath 333 can be used for collecting the cigarette ash and other debris. Similar to the tamper-resistant container 250 described above, the proximal end of the cleaner 332 can sealing engage a seal to inhibit the odor from escaping the cleaner 332 and/or the container 300.

Lighter

A lighter 390 can include a heating element 391 and an electronic circuitry 393 (see e.g., FIG. 12) that is configured to activate or deactivate the heating element 391. Activation of the heating element 391 can cause an electrical current to pass through and resistive heating can increase its surface temperature sufficiently to ignite a cigarette. The lighter 390 can include a battery 392 to power the electric circuitry. In some embodiments, the battery 392 can be rechargeable, and the lighter 390 can have an interface 394 that can be used to connect the rechargeable battery 392 to an external charger. One exemplary, but non-limiting example of such an interface 394 can be a USB port.

In some embodiments, the operation of the electronic circuitry 393 can be controlled by the switch 360, which can be turned ON or OFF. For example, the electronic circuitry 393 can deactivate the heating element 391 when the switch 360 is turned OFF (e.g., the circuit is opened), and the electronic circuitry 393 cannot activate the heating element 391 unless the switch 360 is turned ON (e.g., the circuit is closed). In some embodiments, the electronic circuitry 393 can be further coupled to another controlling element, which can function as a safety mechanism to prevent accidentally turning ON the switch (e.g., closing the circuit) and activating the heating element 391. For example, the controlling element can be the latch 340, and the electronic circuitry 393 can be configured to activate the heating element 391 only when the latch 340 is in the released position and the switch 360 is turned ON, and deactivate the heating element 391 when the latch 340 is in the locked position or the switch 360 is turned OFF. In another example, the controlling element can be the shaft 380, and the electronic circuitry 393 can be configured to activate the heating element 391 only when the shaft 380 is in the deployment position and the switch 360 is turned ON, and deactivate the heating element 391 when the shaft 380 is in the closed position or the switch 360 is turned OFF. Alternatively, the controlling element can be the cap 320, and the electronic circuitry 393 can be configured to activate the heating element 391 only when the cap 320 is open (i.e., the compartment 310 is exposed) and the switch 360 is turned ON, and deactivate the heating element 391 when the cap 320 is closed (i.e., the compartment 310 is covered) or the switch 360 is turned OFF. For example, contact between the upper stop 344 can close a portion of the circuitry so when the switch 360 is turned ON, current flows to the heating element 391. Alternatively, the lower stop 346 can activate, e.g., a relay to open the circuitry, such that even if the switch 360 is turned ON, electrical flow through the heating element 391 is inhibited or altogether prevented when the cap 320 is closed. In addition, the electronic circuitry 393 may be coupled to an indicator (not shown) so as to provide a user perceivable signal (e.g., LED light, beep sound, etc.) that indicates the status of the electronic circuit (e.g., activated or deactivated) and/or the temperature of the heating element 391.

Alternative Tamper-Resistant Container

Figure 13B:
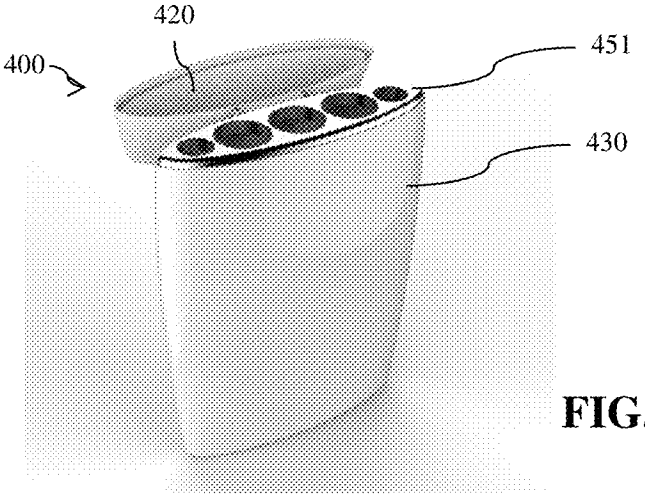
FIG. 13B shows a perspective view from above the tamper-resistant container depicted in FIG. 13A.
Figure 13C:
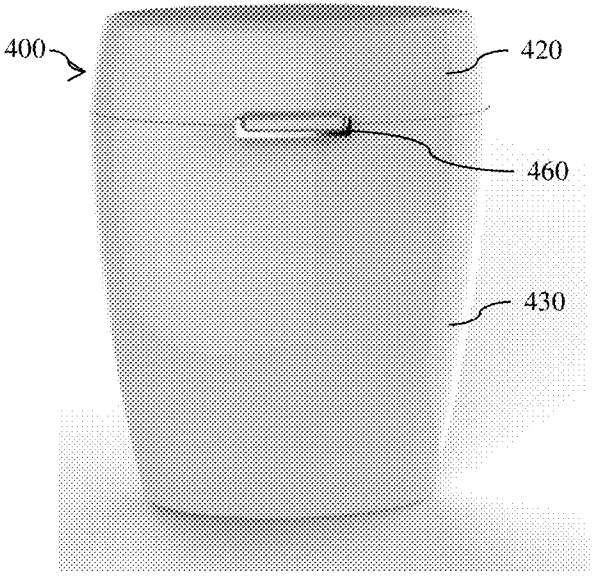
FIG. 13C shows a rear elevation view of the tamper-resistant container depicted in FIG. 13A.
Figure 13A:
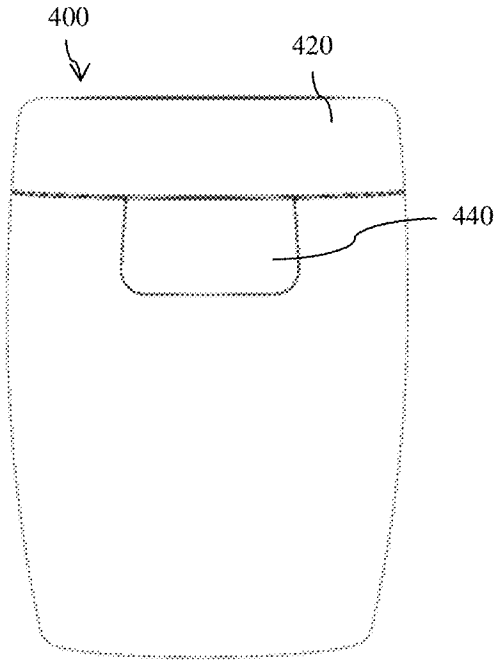
FIG. 13A shows a front elevation view of another tamper-resistant container.
Figure 14:
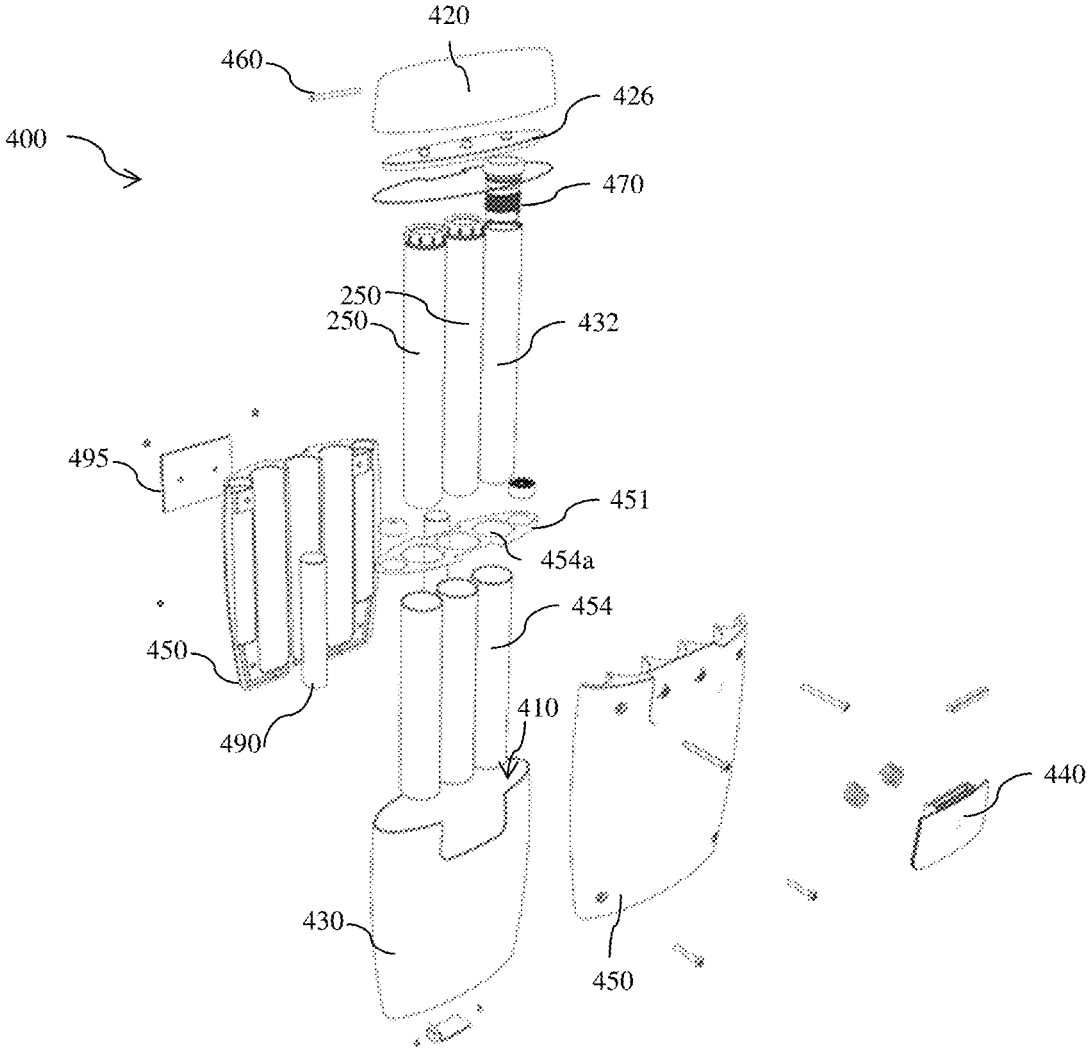
FIG. 14 shows an exploded view of the tamper-resistant container depicted in FIG. 13A.

FIGS. 13A-13C show different views of another embodiment of a tamper-resistant container 400 and FIG. 14 shows several structural components.

As shown, the container 400 can include a hinged cap 420, an interior frame 450, and a body cover, or case 430 defining an interior compartment 410 that slidably receive the interior frame 450. The case 430 can be complementarily arranged relative to the cap 420 to enclose the compartment 410 when the cap 420 covers a top opening of the compartment 410. The cap 420 can be hingedly connected to the case 430 via a hinge 460. The cap 420 can be coupled to an opener 440 (e.g., a button, a clip, a mechanical or electrical switch, etc.). Activation of the opener 440 is configured to open the cap 420 and expose the compartment 410. The hinge 460 and the opener 440 may be positioned at opposite sides of the container 400, or they may be positioned in another selected region of the case 430.

The interior frame 450 can have an upper plate 451 defining a plurality of apertures 454*a*, each configured to slidably receive a container 250. In some embodiments, a receptacle 454 can be positioned in correspondence with each aperture 454*a*. In some embodiments, each receptacle 454 can be complementarily sized and shaped to slidably receive a tamper-resistant container 250 described above. In some embodiments, one receptacle 454 may also be configured to removably receive a cleaner 432 as described above. In certain embodiments, the interior frame 450 may also be configured to receive a cigarette lighter 490 or another component or accessory as described above.

In some embodiments, the container 400 can include a switch 495, which can be operatively coupled to the lighter 490 to control its operation. For example, the lighter 490 can be deactivated when the switch 495 is turned OFF, and the lighter 490 cannot be activated unless the switch 495 is turned ON. The opener 440 and/or the cap 420 can also be operatively coupled to the lighter 490 so as to implement a safety mechanism for the operation of the lighter 490. For example, the lighter 490 can be configured to be activated only when the cap 420 is open and the switch 495 is turned ON, and be deactivated when the cap 420 is closed or the switch 495 is turned OFF.

In certain embodiments, the container 400 can also include a seal member 426 positioned underneath or as part of the cap 420 and over the upper plate 451 of the interior frame 450. The seal member 426 can be made of any sealing materials, such as rubber, silicone, etc., to provide air-tight and water-resistant properties of the container 400 when the cap 420 is closed.

Each of the above described components, e.g., the cap 420, the case 430, the interior frame 450, the opener 440, the switch 495, etc., can be made of any suitable material, e.g., aluminum, alloy, plastic, or other types of materials.

III. Kit Assembly

Figure 15B:
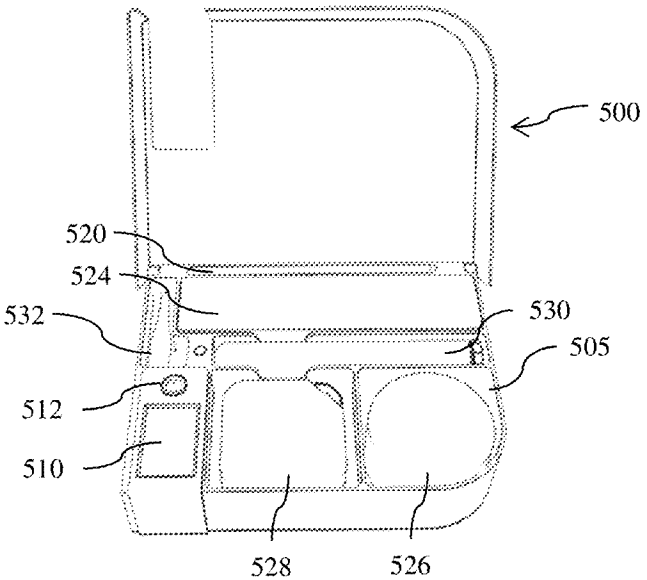
FIG. 15B shows the tamper-resistant closure kit assembly depicted in FIG. 15A where its lid is open.
Figure 15A:
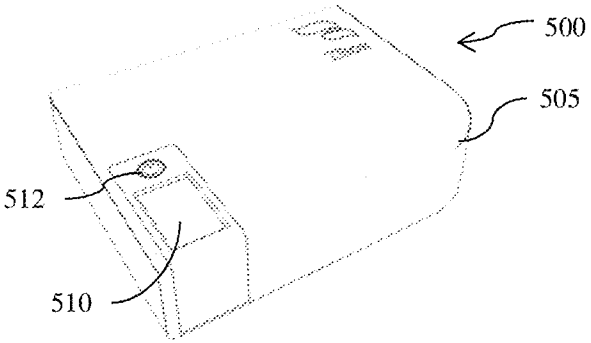
FIG. 15A shows a perspective view of another tamper-resistant closure kit assembly.
Figure 15C:
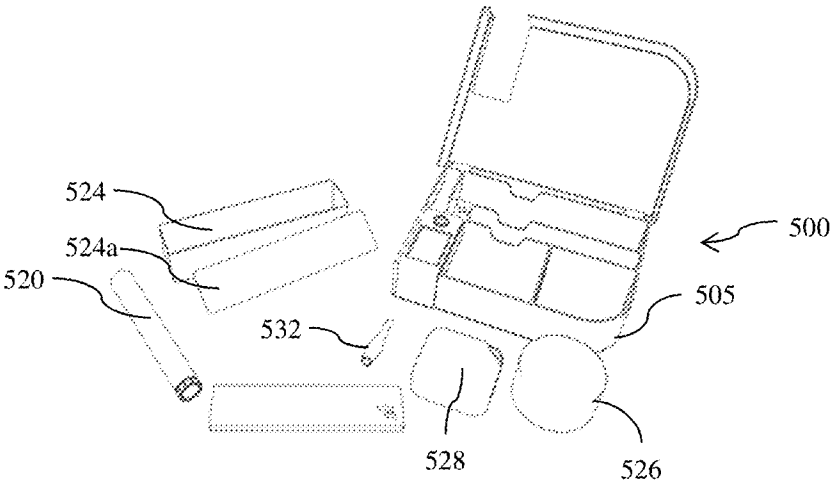
FIG. 15C shows the tamper-resistant closure kit assembly depicted in FIG. 15A where some components of the kit assembly are taken outside of the kit assembly.

FIG. 15A-C show a tamper-resistant, waterproof, and airtight kit assembly 500, which can contain a plurality of necessary elements to manually assemble a tobacco and some related accessories. For example, the kit assembly 500 can include a hermetically sealed box 505 for the storage of tobacco or other cigarette fill materials, keeping them fresh and safe from elements like air and light. For example, the box 505 may be made of stainless steel and have a polycarbonate odor proof airtight lid. Other materials can also be used.

The kit assembly 500 can have a tamper-resistant opener 510. In some embodiments, the tamper-resistant opener 510 can include a fingerprint recognition system that allows only authorized user who has the matching fingerprint to access the contents stored inside the kit assembly 500. Other techniques can also be incorporated in the tamper-resistant opener 510, e.g., the voice authentication system, the iris recognition system, the password protected keypad, etc. An indicator 512 may provide a user perceivable feedback (e.g., LED display, sound, etc.) on the status of the kit assembly 500 (e.g., battery power, temperature, humidity, lid open or close, etc.). In addition, a key and a lock (not shown) may also be provided for mechanically opening the kit assembly 500 if necessary.

Some representative, but non-limiting components contained in the kit assembly 500 can include: a grinder 526, a humidor 524, a pack of rolling papers 520 of varying sizes (e.g., super slim, standard, king, etc.), a smoking tip 532, a set of wood matches, a USB lighter 528, one or more tamper-resistant containers 530, a battery (not shown), etc. The humidor 524 may be made of a metallic or plastic box with a plastic or metallic cover 524*a* for the storage of tobacco or other cigarette fill materials. The humidor 524 may have sensors that measure the temperature and humidity inside the box and may also contain a control circuit and associated actuators to adjust the temperature and humidity.

VI. Other Embodiments

It should be understood that the various types of assemblies described above represent only exemplary embodiments of the inventive subject matter. Other embodiments can be implemented based on the same general principles described herein.

Directions and other relative references, e.g., up, down, left, right, etc., may be used to facilitate discussion of the drawings and principles herein, but are not intended to be limiting. For example, certain terms may be used such as "upper," "lower," "horizontal," "vertical," "top", "bottom," and the like. Such terms are used, where applicable, to provide some clarity of description when dealing with relative relationships, particularly with respect to the illustrated embodiments. Such terms are not, however, intended to imply absolute relationships, positions, and/or orientations. As used herein, "and/or" means "and" or "or", as well as "and" and "or." Moreover, all patent and non-patent literature cited herein is hereby incorporated by reference in its entirety for all purposes.

The principles described above in connection with any particular example can be combined with the principles described in connection with another example described herein. Accordingly, this detailed description shall not be construed in a limiting sense, and following a review of this disclosure, those of ordinary skill in the art will appreciate the wide variety of tamper-resistant closure devices can be devised using the various concepts described herein.

Moreover, those of ordinary skill in the art will appreciate that the exemplary embodiments disclosed herein can be adapted to various configurations and/or uses without departing from the disclosed principles. Applying the principles disclosed herein, it is possible to provide a wide variety of tamper-resistant closure assemblies adapted to store articles other than the cigarettes.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". All structural and functional equivalents to the features and method acts of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

Thus, in view of the many possible embodiments to which the disclosed principles can be applied, we reserve to the right to claim any and all combinations of features and technologies described herein as understood by a person of ordinary skill in the art, including, for example, all that comes within the scope and spirit of the following claims.

We currently claim:

1. A tamper-resistant closure assembly, comprising:

an elongate body having a proximal end and a distal end;

a ferrule defining an interior major surface, wherein the interior major surface has a proximal region and a distal region; and a boss positioned adjacent the distal end of the elongate body and configured to resiliently urge outwardly against the interior major surface;

wherein the elongate body is slidably retained within the ferrule by a shoulder extending radially outward of the elongate body;

wherein the ferrule, the elongate body, or both defines a region so complementarily arranged relative to the boss as to resiliently urge the elongate body in a proximal direction relative to the ferrule in correspondence with a radially outward force applied by the boss against the interior major surface, wherein the elongate body further comprises a first plurality of juxtaposed teeth spaced apart from each other to define a first plurality of juxtaposed recesses therebetween, and the ferrule further comprises a second plurality of juxtaposed teeth spaced apart from each other to define a second plurality of juxtaposed recesses therebetween, wherein the first plurality of juxtaposed teeth are complementary to the second plurality of juxtaposed recesses, and the second plurality of juxtaposed teeth are complementary to the first plurality of juxtaposed recesses.

2. The tamper-resistant closure assembly of claim 1, wherein the boss defines a portion of a spring lever disposed within a region of the elongate body.

3. The tamper-resistant closure assembly of claim 1, wherein the elongate body has a first and a second recess regions that are joined by a transition region, each respective region being complementarily sized to matingly receive a correspondingly sized suction-end of a cigarette.

4. The tamper-resistant closure assembly of claim 1, wherein the proximal region has a greater cross-sectional dimension than the distal region, and a sloped face is positioned between the proximal region and the distal region.

5. The tamper-resistant closure assembly of claim 1, wherein the boss can be urged toward the distal position when the elongate body is pressed toward a lowered position by applying a pressure to the proximal end, so that the first plurality of juxtaposed teeth and the corresponding recesses can rotationally engage the complementary second plurality of juxtaposed recesses and the corresponding teeth, and the boss can expand outwardly and move toward the proximal region thereby urging the elongate body to a raised position when the pressure is released, so that the first plurality of juxtaposed teeth and the corresponding recesses disengage the complementary second plurality of juxtaposed recesses and the corresponding teeth.

6. A tamper-resistant closure assembly, comprising:

a sheath;

an elongate body having a proximal end and a distal end;

a ferrule defining an interior major surface, wherein the interior major surface has a proximal region and a distal region; and a boss positioned adjacent the distal end of the elongate body and configured to resiliently urge outwardly against the interior major surface;

wherein the elongate body is slidably retained within the ferrule by a shoulder extending radially outward of the elongate body;

wherein the ferrule, the elongate body, or both defines a region so complementarily arranged relative to the boss as to resiliently urge the elongate body in a proximal direction relative to the ferrule in correspondence with a radially outward force applied by the boss against the interior major surface;

wherein the ferrule has an external engagement member configured to removably couple with a complementarily arranged region of the sheath;

wherein the elongate body further comprises a first plurality of juxtaposed teeth spaced apart from each other to define a first plurality of juxtaposed recesses therebetween, and the ferrule further comprises a second plurality of juxtaposed teeth spaced apart from each other to define a second plurality of juxtaposed recesses therebetween, wherein the first plurality of juxtaposed teeth are complementary to the second plurality of juxtaposed recesses and the second plurality of juxtaposed teeth are complementary to the first plurality of juxtaposed recesses.

7. The tamper-resistant closure assembly of claim 6, wherein the external engagement member comprises an external thread and the complementarily arranged region of the sheath comprises an internal thread that is complementary to the external thread.

8. The tamper-resistant closure assembly of claim 6 further comprises a seal member that extends from an external surface of the elongate body to a corresponding internal surface of the sheath to sealingly engage the sheath when the external engagement member is coupled with the complementarily arranged region of the sheath.

9. The tamper-resistant closure assembly of claim 6, wherein the boss defines a portion of a spring lever disposed within a region of the elongate body.

10. The tamper-resistant closure assembly of claim 6, wherein the boss comprises a resilient ring structure.

11. The tamper-resistant closure assembly of claim 6, wherein the elongate body has a first and a second recess regions that are joined by a transition region, each respective region being complementarily sized to matingly receive a correspondingly sized suction-end of a cigarette.

12. The tamper-resistant closure assembly of claim 6, wherein the proximal region has a greater cross-sectional dimension than the distal region, and a sloped face is positioned between the proximal region and the distal region.

13. The tamper-resistant closure assembly of claim 6, wherein the boss can be urged toward the distal position when the elongate body is pressed toward a lowered position by applying a pressure to the proximal end, so that the first plurality of juxtaposed teeth and the corresponding recesses can rotationally engage the complementary second plurality of juxtaposed recesses and the corresponding teeth, and the boss can expand outwardly and move toward the proximal region thereby urging the elongate body to a raised position when the pressure is released, so that the first plurality of juxtaposed teeth and the corresponding recesses disengage the complementary second plurality of juxtaposed recesses and the corresponding teeth.

14. A tamper-resistant closure assembly, comprising:

a sheath having an internal thread;

an elongate body having a proximal end and a distal end;

a ferrule defining an interior major surface, wherein the interior major surface has a proximal region and a distal region, and the ferrule further comprises an external thread that is complementary to the internal thread of the sheath so that the ferrule can be removably coupled with the sheath;

a seal member that extends from an external surface of the elongate body to a corresponding internal surface of the sheath to sealingly engage the sheath when the external thread of the ferrule is coupled with the internal thread of the sheath; and a boss positioned adjacent the distal end of the elongate body and configured to resiliently urge outwardly against the interior major surface;

wherein the elongate body is slidably retained within the ferrule by a shoulder extending radially outward of the elongate body;

wherein the ferrule, the elongate body, or both defines a region so complementarily arranged relative to the boss as to resiliently urge the elongate body in a proximal direction relative to the ferrule in correspondence with a radially outward force applied by the boss against the interior major surface; and wherein the elongate body further comprises a first plurality of juxtaposed teeth spaced apart from each other to define a first plurality of juxtaposed recesses therebetween, and the ferrule further comprises a second plurality of juxtaposed teeth spaced apart from each other to define a second plurality of juxtaposed recesses therebetween, wherein the first plurality of juxtaposed teeth are complementary to the second plurality of juxtaposed recesses and the second plurality of juxtaposed teeth are complementary to the first plurality of juxtaposed recesses.

15. An opening-resistant assembly for a container, comprising:

a cap defining a user-graspable region;

an externally threaded member defining an external thread positioned distally of the user-graspable region of the cap, wherein the cap and the externally threaded member are longitudinally moveable relative to each other from a first extent to a second extent, wherein, at the first extent, the cap and the externally threaded member are so circumferentially disengaged from each other as to be independently rotatable, and wherein, at the second extent, the cap and the externally threaded member so circumferentially engage with each other as to be circumferentially co-rotatable; and an O-ring seated in a groove positioned between the user-graspable region of the cap and the external thread.

16. The opening-resistant assembly according to claim 15, further comprising: a sheath defining an opening at a proximal end to receive the externally threaded member, wherein the sheath further defines a complementarily configured internal thread positioned distally of the opening and being operative to threadably engage with the external thread of the externally threaded member.

17. The opening-resistant assembly according to claim 16, wherein, at the first extent and when the external thread of the externally threaded member and the internal thread of the sheath are threadably engaged with each other, the cap is independently rotatable with respect to both the externally threaded member and the sheath;

wherein, at the second extent and when the external thread of the externally threaded member and the internal thread of the sheath are threadably engaged with each other, the cap and the externally threaded member are co-rotatable to threadably disengage the externally threaded member from the sheath.

18. The opening-resistant assembly according to claim 16, wherein the sheath defines an internal surface to sealingly engage with the O-ring seated in the groove defined by the cap, wherein the internal surface defined by the sheath is positioned distally of the opening and proximally of the internal thread defined by the sheath.

19. The opening-resistant assembly according to claim 18, wherein the O-ring is configured to provide at least one of a water resistant or an air-tight seal between the externally threaded member and the interior surface of the sheath.

20. The opening-resistant assembly according to claim 17, wherein the sheath is operative to enclose a cigarette suspended therein by the cap and externally threaded member assembly.

21. The opening-resistant assembly according to claim 15, wherein the cap and the externally threaded member are so longitudinally engaged with each other as to inhibit longitudinal displacement past the first extent relative to each other.

22. The opening-resistant assembly according to claim 21, wherein the cap defines a shoulder and the externally threaded member defines a complementary shoulder, wherein the shoulder and the complementary shoulder urge against each other at the first extent to inhibit longitudinal displacement past the first extent.

23. The opening-resistant assembly according to claim 15, wherein the cap comprises a first a plurality of teeth and the externally threaded member comprises a second plurality of teeth, and wherein the first plurality of teeth circumferentially engage the second plurality of teeth at the second extent.

24. The opening-resistant assembly according to claim 15, wherein, at the second extent, the cap and the externally threaded member are circumferentially co-rotatable when the user-graspable region is rotated circumferentially.

25. The opening-resistant assembly according to claim 15, wherein the cap and externally threaded member assembly defines a recess for holding a suction-end of a cigarette.

26. The opening-resistant assembly according to claim 25, further comprising a floor defining a fluted aperture and a plurality of resilient flaps operative to urge against and to frictionally engage a suction-end of a cigarette extending through the aperture.

27. The opening-resistant assembly according to claim 26, comprising a sheath insert disposed inside the recess, wherein the floor constitutes a portion of the sheath insert.

28. The opening-resistant assembly according to claim 26, wherein the floor comprises a pliant member matingly engaged with a distal end of the recess.

29. An opening-resistant assembly for a container, comprising:

an elongate body defining a user-graspable region and having a first plurality of teeth;

a ferrule overlying the elongate body and having a second plurality of teeth, wherein the ferrule defines an external thread positioned distally of the user-graspable region of the elongate body, wherein the ferrule defines an open distal end and a recess extending proximally from the open distal end to receive a suction-end of a cigarette;

a plurality of resilient flaps extending across the recess at the open distal end to define a fluted aperture opening to the recess, wherein the resilient flaps are operative to deflect inwardly as the suction-end of the cigarette urges through the fluted aperture and to frictionally engage with the suction-end of the cigarette when the suction-end of the cigarette extends through the fluted aperture, wherein the elongate body and the ferrule are longitudinally moveable relative to each other from a first extent to a second extent, wherein, at the first extent, the elongate body and the ferrule are independently rotatable, and wherein, at the second extent, the first plurality of teeth and the second plurality of teeth circumferentially engage with each other such that the elongate body and the ferrule are circumferentially co-rotatable;

an O-ring seated in a groove positioned between the user-graspable region of the elongate body and the external thread; and a sheath defining an opening at a proximal end to receive the ferrule, a complementarily configured internal thread operative to threadably engage with the external thread of the ferrule, and sized to enclose a cigarette suspended within the fluted aperture, and defining an internal surface to sealingly engage with the O-ring seated in the groove, wherein, at the first extent and when the external thread of the ferrule and the internal thread of the sheath are threadably engaged with each other, the elongate body is independently rotatable with respect to the ferrule and to the sheath, wherein, at the second extent and when the external thread of the ferrule and the internal thread of the sheath are threadably engaged with each other, the elongate body and the ferrule are circumferentially co-rotatable to threadably disengage the ferrule from the sheath.

30. The opening-resistant assembly for a container according to claim 29, further comprising:

a boss positioned adjacent a distal end of the elongate body and configured to resiliently urge outwardly against the ferrule overlying the elongate body;

wherein the ferrule, the elongate body, or both defines a region so complementarily arranged relative to the boss as to resiliently urge the elongate body in a proximal direction relative to the ferrule in correspondence with a radially outward force applied by the boss against the ferrule.

* * * * *